US012331978B2

(12) United States Patent
Hong et al.

(10) Patent No.: US 12,331,978 B2
(45) Date of Patent: Jun. 17, 2025

(54) REFRIGERATOR

(71) Applicant: LG ELECTRONICS INC., Seoul (KR)

(72) Inventors: Jinil Hong, Seoul (KR); Nayoung Kim, Seoul (KR); Ayoung Choo, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 18/381,435

(22) Filed: Oct. 18, 2023

(65) Prior Publication Data

US 2024/0044565 A1 Feb. 8, 2024

Related U.S. Application Data

(63) Continuation of application No. 17/717,942, filed on Apr. 11, 2022, now Pat. No. 11,828,514.

(30) Foreign Application Priority Data

Apr. 19, 2021 (KR) ..... 10-2021-0050607

(51) Int. Cl.
*F25C 1/24* (2018.01)

(52) U.S. Cl.
CPC ..... *F25C 1/24* (2013.01)

(58) Field of Classification Search
CPC ..... F25C 1/24; F25D 23/04
See application file for complete search history.

(56) References Cited

U.S. PATENT DOCUMENTS 8,522,566 B2 9/2013 LeClear et al.
11,828,514 B2 11/2023 Hong et al.
2011/0138828 A1* 6/2011 Leclear ..... F25C 5/187 62/344
2012/0111048 A1 5/2012 Kim et al.
2013/0014536 A1* 1/2013 Son ..... F25C 1/25 62/340
2019/0003758 A1 1/2019 Scalf et al.
2019/0145686 A1 5/2019 Kim
2020/0224957 A1* 7/2020 Gomes ..... F25D 23/04
2022/0333839 A1 10/2022 Hong et al.

FOREIGN PATENT DOCUMENTS

CN 103423939 A 12/2013
KR 20120069686 6/2012
KR 1020210005774 A 1/2021

OTHER PUBLICATIONS

Extended European Search Report in European Appln. No. 22168719.7, dated Sep. 16, 2022, 8 pages.
Office Action in Chinese Appln. No. 2022104098075, mailed on Oct. 19, 2023, 7 pages (with English translation).

* cited by examiner

*Primary Examiner* — Elizabeth J Martin
(74) *Attorney, Agent, or Firm* — Fish & Richardson P.C.

(57) ABSTRACT

A refrigerator includes a cabinet defining a storage space, a door configured to open and close at least a portion of the storage space, and an evaporator configured to generate cold air. The refrigerator also includes a first ice maker provided in the door, a second ice maker provided in the storage space and configured to be covered by the door when the door is closed, a first cold air guide configured to guide the cold air to the first ice maker, and a second cold air guide configured to guide the cold air to the second ice maker.

20 Claims, 21 Drawing Sheets

REFRIGERATOR

CROSS-REFERENCE TO RELATED APPLICATIONS

The present application is a continuation of U.S. application Ser. No. 17/717,942, filed on Apr. 11, 2022, which claims priority under 35 U.S.C. 119 and 35 U.S.C. 365 to Korean Patent Application No. 10-2021-0050607, filed on Apr. 19, 2021. The contents of the aforementioned applications are hereby incorporated by reference in their entirety.

BACKGROUND

The present disclosure relates to a refrigerator.

In general, refrigerators are home appliances for storing foods at a low temperature in a storage chamber that is covered by a door. To this end, the refrigerator is configured to keep stored food in an optimal state by cooling the inside of the storage space using cold air generated through heat exchange with a refrigerant circulating in a refrigeration cycle.

Recently, refrigerators are gradually becoming larger and more multifunctional in accordance with the change in dietary habits and the trend of luxury products. For instance, refrigerators having various structures and convenient devices for user convenience and efficient use of internal space have been released.

In particular, recent refrigerators are provided with an automatic ice maker capable of automatically making and storing ice. In some cases, an ice maker is provided in a freezing compartment. In the refrigerator having such a structure, a cold air discharge port may be formed at the rear of the ice maker so as to ensure the ice making performance of the ice maker. However, in the case of such a structure, at least a part of the discharge port may be covered by the ice maker. As a consequence, cold air may not be effectively supplied to a space in front of the ice maker. In addition, if cold air is not circulated in the space in front of the ice maker and becomes stagnant, frost may be generated in this space. This may cause inconvenience to users and cause a deterioration in refrigeration performance.

SUMMARY

An implementation of the present disclosure aims to provide an ice maker and a refrigerator capable of smoothly supplying cold air to the front of the ice maker.

An implementation of the present disclosure aims to provide a refrigerator capable of being applied to refrigerators having various depths and capable of evenly supplying cold air therein.

An implementation of the present disclosure aims to provide a refrigerator capable of evenly supplying cold air to two ice makers disposed in a freezing compartment.

An implementation of the present disclosure aims to provide a refrigerator capable of evenly supplying cold air to two ice makers plurality freezing compartment.

A refrigerator according to an implementation of the present disclosure may include a cabinet defining a storage space to which cold air is supplied through a cold air discharge port, a door opening or closing the storage space, an ice maker provided in the storage space to make ice, an ice maker cover mounted to the ice maker and defining a cold air passage that bypasses the ice maker and directs toward a front of the ice maker, and a distribution passage provided between the cold air discharge port and the ice maker to supply cold air discharged from the cold air discharge port, wherein the distribution passage may include a cooling guide portion communicating with the ice maker cover and defining a cooling passage that guides cold air to the ice maker cover, and an ice making guide portion branched from the cooling guide portion and communicating with the ice maker to define an ice making passage that guides cold air to the ice maker.

The cold air discharge port may be provided at a rear surface of the storage space, and the ice maker may shield the cold air discharge port at a front.

The ice maker cover may be provided between an upper surface of the storage space and an upper surface of the ice maker, and a cover passage through which the cooling guide portion and the front of the ice maker communicate with each other may be defined.

The ice maker cover may include a cover body that shields the upper surface of the ice maker, and a lower surface of the cover body may be opened to define a space in which the upper surface of the ice maker is accommodated.

The upper surface of the cover body may be provided with a sidewall that extends upward, may be in contact with the upper surface of the storage space, and may define the cover passage, and a rear end of the sidewall may communicate with the cooling guide portion.

The upper surface of the cover body may be provided with a guide surface defining a bottom surface of the cover passage, and the guide surface may be inclined.

The refrigerator may further include a discharge guide protruding from an inner side of the cover passage and guiding a flow direction of the cold air flowing along the cover passage.

The discharge guide may be inclined toward one side closer to a rotation shaft of the door among left and right sides.

The ice maker may include: an ice maker case including a case upper surface defining an upper surface and a case circumferential surface extending downward along a circumference of a case upper surface and defining a downwardly opened space; and an ice tray mounted inside the ice maker case and forming a plurality of cells in which ice is made, and the ice maker cover may be coupled to shield an upper surface of the ice maker case.

A rear end of the case upper surface may be provided with a case inlet communicating with the ice making guide portion to allow cold air to flow into the ice maker.

A front end of the case upper surface may be provided with a case outlet through which cold air flowing into the case inlet is discharged, and the plurality of cells may be disposed between the case inlet and the case outlet.

The cooling guide portion may include: a guide portion base extending from the cold air discharge port and defining a bottom of the cooling passage; and a guide portion side extending upward from both ends of the guide portion base and coming in contact with an upper surface of the storage space.

The guide portion base and the guide portion side may be connected to an inlet of the cover passage.

The ice making passage may include a duct extension portion extending from a base opening defined in the guide portion base and extending to communicate with an inside of the ice maker to define the ice making passage.

The base opening may include a vertical extension portion extending upward and guiding a part of the cold air flowing into the cooling passage to the ice making passage.

The door may be provided with a door ice maker that makes ice, a door duct extending up to an upper side of the door ice maker and supplying cold air toward the door ice maker when the door is closed may be provided on the upper surface of the storage space, and an outlet of the cover passage may be opened at a position facing the door ice maker.

A front cover shielding the ice maker from a front may be disposed on a front of the ice maker, and a front discharge port communicating with the cover passage may be defined in the front cover.

The front discharge port may be defined between the upper surface of the storage space and an upper end of the front cover.

The cold air discharge port may be defined in a grille pan that shields an evaporator, and the distribution guide may be fixedly mounted to the grille pan so as to communicate with the cold air discharge port.

The storage space may be partitioned left and right to define a refrigerating compartment and a freezing compartment, the ice maker may be formed inside the freezing compartment in a size corresponding to a width of the freezing compartment, and spherical cells that make ice inside the ice maker may be continuously disposed in a left-and-right direction.

DETAILED DESCRIPTION

Hereinafter, detailed implementations will be described in detail with reference to the accompanying drawings. However, the scope of the present disclosure is not limited to proposed implementations of the present disclosure, and other regressive disclosures or other implementations included in the scope of the spirits of the present disclosure may be easily proposed through addition, change, deletion, and the like of other elements.

In addition, in implementations of the present disclosure, a side-by-side type (or a double-door type) refrigerator in which a pair of doors are disposed on left and right sides will be described as an example for convenience of explanation and understanding, and it is noted that the present disclosure is applicable to any refrigerators provided with a dispenser.

Figure 1:
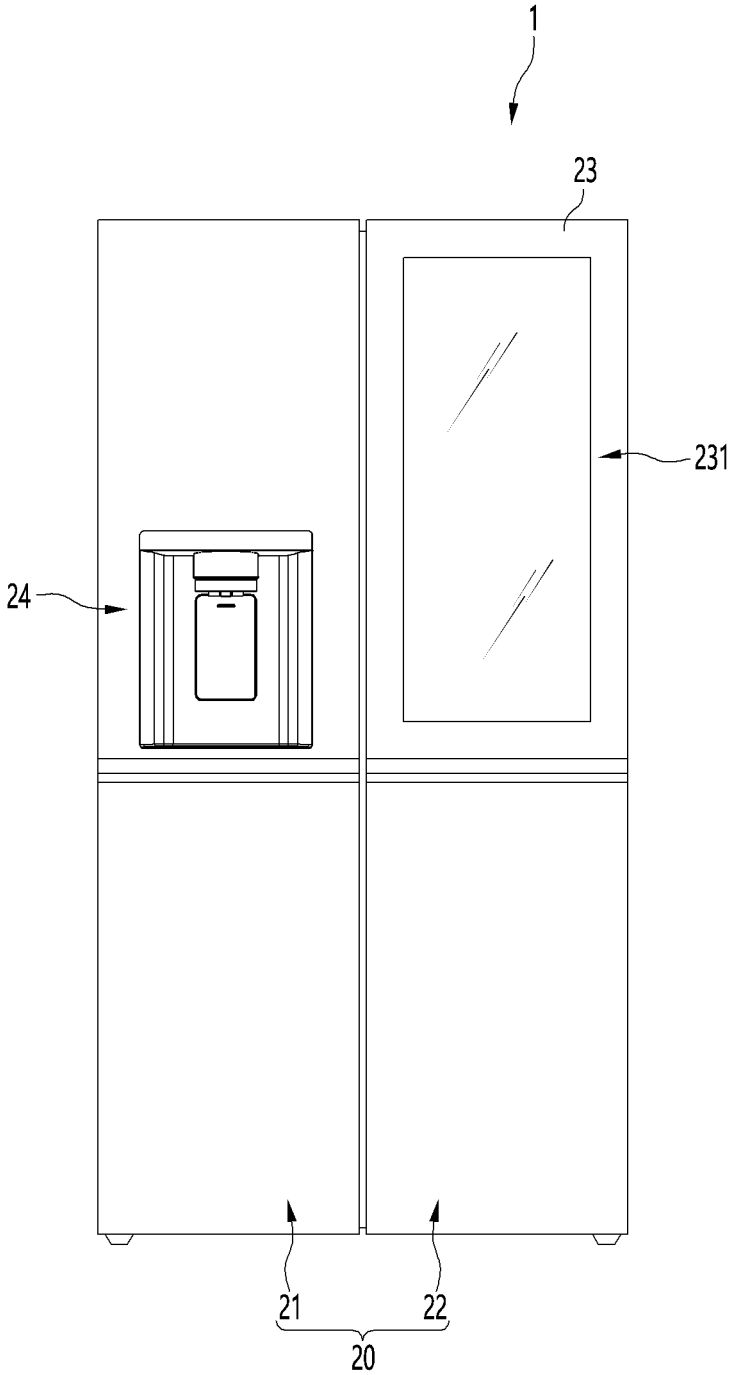
FIG. 1 is a front view of an example refrigerator according to an implementation of the present disclosure.
Figure 2:
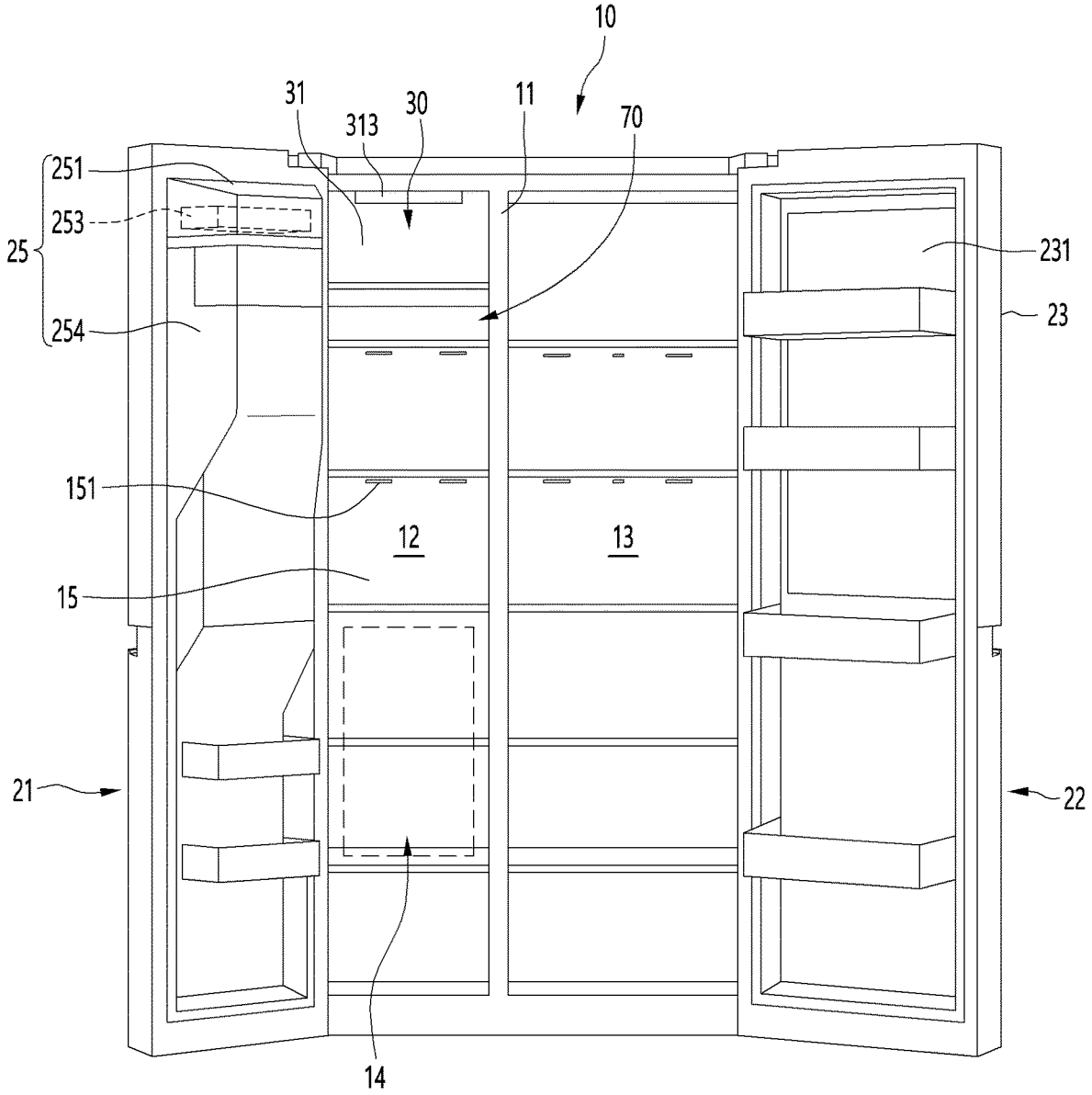
FIG. 2 is a front view illustrating an example state in which a door of the refrigerator is opened.

Prior to the description, the directions are defined below for improved clarity. In FIGS. 1 and 2, a direction toward a door with respect to a cabinet may be defined as "front" or "forward," a direction toward the cabinet with respect to the door may be defined as "rear" or "rearward," a direction toward the floor where the refrigerator is installed may be defined as "downward," and a direction away from the floor where the refrigerator is installed may be defined as "upward."

Figure 3:
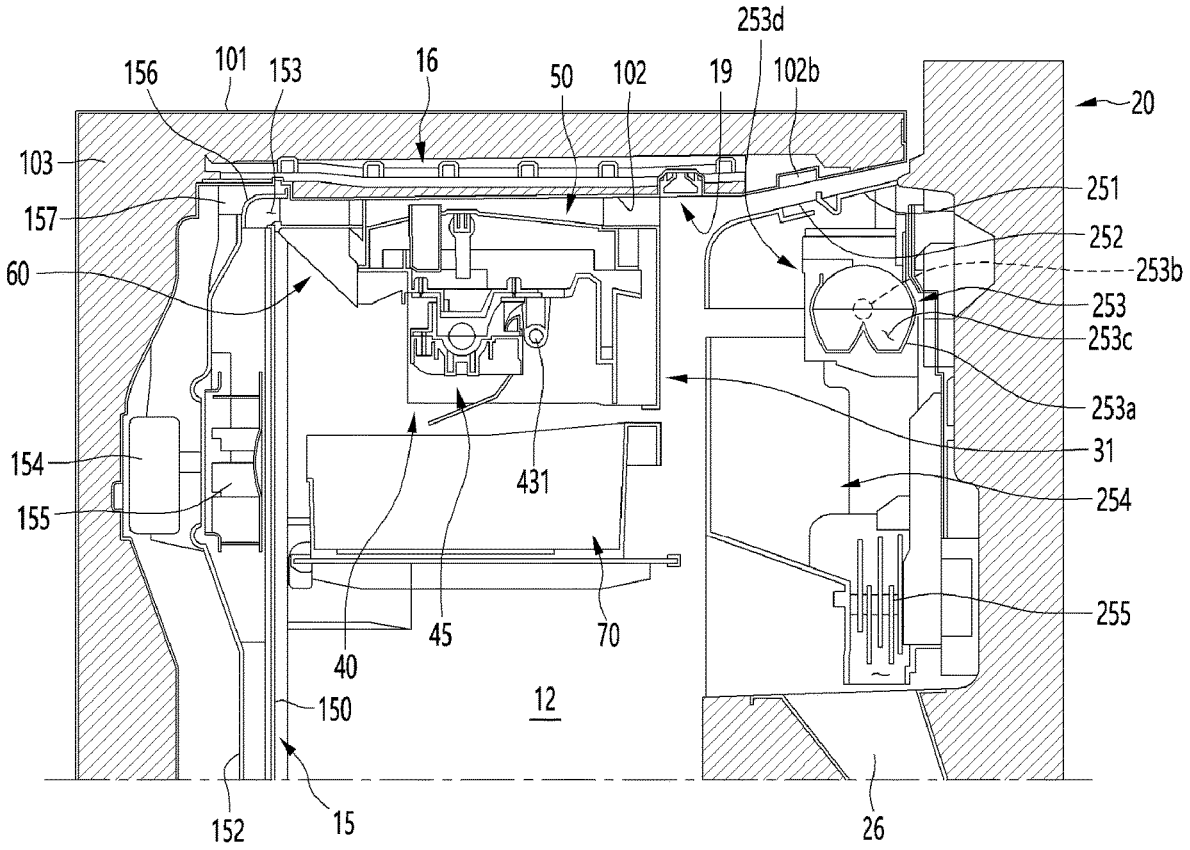
FIG. 3 is a cross-sectional view of an upper portion of a freezing compartment of the refrigerator.

FIG. 1 is a front view of a refrigerator according to an implementation of the present disclosure. Also, FIG. 2 is a front view illustrating a state in which the door of the refrigerator is opened. Also, FIG. 3 is a cross-sectional view of an upper portion of a freezing compartment of the refrigerator.

As shown in the drawings, an outer appearance of a refrigerator 1 according to the implementation of the present disclosure may be defined by a cabinet 10 defining a storage space and a door 20 coupled to the cabinet 10 to open or close the storage space.

The cabinet 10 may include an outer case 101 defining an outer appearance and an inner case 102 disposed inside the outer case 101 to define the storage space. A heat insulating material 103 may be filled between the outer case 101 and the inner case 102.

A barrier 11 may be formed in the inner case 102. The barrier 11 may partition the storage space inside the cabinet 10 left and right, so that a freezing compartment 12 and a refrigerating compartment 13 are defined side by side. The inner case 102 may define inner surfaces of the freezing compartment 12 and the refrigerating compartment 13. If necessary, the inner case 102 defining the refrigerating compartment 13 and the inner case 102 defining the freezing compartment may be formed independently.

Storage members such as drawers and shelves may be disposed inside the freezing compartment 12 and the refrigerating compartment 13.

An evaporator 14 may be provided at the rear of the freezing compartment 12, and the evaporator 14 may be shielded by a grille pan 15. The grille pan 15 may define rear wall surfaces of the refrigerating compartment 13 and the freezing compartment 12. The grille pan 15 may be provided with a shroud 152 defining a passage through which cold air generated by the evaporator 14 may flow. A fan motor 154 and a blowing fan 155 are provided in the shroud 152 to allow cool air generated by the evaporator 14 to flow along the passage of the grille pan 15. A discharge port 151 through which cold air is discharged may be defined in the grille pan 15.

An ice maker assembly 30 may be provided in an uppermost space of the freezing compartment 12. The ice maker assembly 30 may include an ice maker 40 capable of making automatically supplied water into ice and separating the ice.

The ice maker assembly 30 may include a distribution duct 60 that allows cold air discharged through the grille pan 15 to be branched and guided to the inside of the ice maker 40 and above the ice maker 40. The ice maker assembly 30 may further include an ice maker cover 50 that allows cold air branched by the distribution duct 60 to pass the upper side of the ice maker 40 and direct toward the front of the ice maker assembly 30. In addition, the ice maker assembly 30 may further include a front cover 31 capable of shielding a part of the space defined at the upper end of the freezing compartment 12.

An ice bin 70 may be provided below the ice maker 40. Ice made by the ice maker 40 may be dropped and stored in the ice bin 70.

The doors 20 may be disposed on both left and right sides of the refrigerator in a side by side manner. The doors 20 may be configured to rotate to open or close the freezing compartment 12 and the refrigerating compartment 13 disposed on the left and right sides. The door 20 may define the front appearance of the refrigerator 1 in a closed state. The door 20 may include a freezing compartment door 21 for opening or closing the freezing compartment 12 and a refrigerating compartment door 22 for opening or closing the refrigerating compartment 13.

The refrigerating compartment door 22 may have an opening communicating with the accommodation space at the rear of the door, and may be further provided with a sub-door 23 opening or closing the opening. At least a part of the sub-door 23 may be provided with a see-through portion 231 through which the inside can be seen.

A door ice maker assembly 25 may be provided at the freezing compartment door 21. The door ice maker assembly 25 may include a door ice maker 253 provided on the upper rear surface of the freezing compartment door 21. The door ice maker 253 may be configured to make ice using automatically supplied water and to separate the made ice to an ice bank 254.

In detail, the door ice maker 253 may include an ice tray 253*a* that contains water and makes ice, and a driving device 253*d* provided on one side of the ice tray 253*a*. The ice tray 253*a* may have an open upper surface, and the inside of the ice tray 253*a* may be partitioned into a plurality of cells 253*c*. The cell 253*c* may have a cube or semicircular shape or the like, and may have a different shape and size from the spherical ice made in the ice maker 40. Spherical ice is typically larger in volume than ice made in the cells 253*c*.

A rotation shaft 235*b* of the ice tray 253*a* may be connected to the driving device 253*d*, and may rotate according to the operation of the driving device 253*d*. That is, the ice tray 253*a* may be configured to rotate for ice separation upon completion of ice making. The door ice maker 253 having such a structure may be referred to as a twist type ice maker. In some cases, the ice tray 253*a* may have a structure to maintain a fixed state, and an ejector may be rotated by the rotation shaft 235*b* connected to the driving device 253*d* to separate the ice from the cell 253*c*.

The door ice maker 253 may be elongated in the horizontal direction (left-and-right direction). Therefore, the rotation shaft 235*b* of the ice tray 253*a* may also extend in the horizontal direction, and the cells 253*c* may be continuously arranged in the horizontal direction.

Compared with the rotation shaft 431 of the ice maker 40, the rotation shaft 235*b* of the door ice maker 253 may extend in the same direction. That is, the rotation shaft 431 of the ice maker 40 and the rotation shaft 235*b* of the door ice maker 253 may be arranged side by side. In this case, the rotation shaft 235*b* of the door ice maker 253 may be located slightly higher than the rotation shaft 431 of the ice maker 40.

The plurality of cells C formed in the ice maker 40 may be continuously arranged in the horizontal direction, and the plurality of cells 253*c* formed in the door ice maker 253 may also be continuously arranged in the horizontal direction. That is, the cells C of the ice maker 40 and the cells 253*c* of the door ice maker 253 may be continuously arranged in the parallel direction.

The ice maker 40 and the door ice maker 253 may be disposed in the same freezing compartment. When the freezing compartment door 21 is closed, the ice maker 40 and the door ice maker 253 may be disposed at positions facing each other.

That is, the front surface of the ice maker assembly 30 may be formed at a position facing the rear surface of the door ice maker assembly 25. The front surface of the ice maker assembly 30 and the rear surface of the door ice maker assembly 25 may be disposed at positions spaced apart from each other. An illumination device 19 for illuminating the inside of the freezing compartment 12 may be disposed in a region between the ice maker assembly 30 and the door ice maker assembly 25.

Both the ice maker 40 and the door ice maker 253 may be located at the uppermost position inside the freezing compartment 12. Therefore, the ice maker 40 and the door ice maker 253 may fill the space at the upper end of the freezing compartment 12 of the side-by-side type refrigerator, which is narrower in the left-and-right direction, compared to other types of refrigerators. In addition, the remaining space of the freezing compartment 12 may be completely used as a space for food storage.

To this end, the ice maker assembly 30 may be formed to have a size corresponding to the width of the left and right side ends of the freezing compartment 12 by arranging the ice maker 40 in the horizontal direction. Due to the horizontal arrangement of the ice maker 40, the distance at which the ice maker assembly 30 protrudes forward may be minimized. Therefore, the arrangement space of the door ice maker assembly 25 protruding from the rear surface of the freezing compartment door 21 may be secured as much as possible.

By arranging the ice maker 40 and the door ice maker 253 side by side in front and rear at the upper end of the inside of the freezing compartment 12, cold air discharged from the rear of the ice maker 40 may be effectively transmitted to the ice maker 40 and the door ice maker 253, and the ice making performance may be secured.

That is, the ice maker 40 may make ice by cold air supplied by the distribution duct 60. The door ice maker 253 may make ice using cold air supplied by the door duct 16 provided on the upper surface of the inner case 102.

The door ice maker cover 251 may be provided above the door ice maker 253. The door ice maker cover 251 has a cover inlet 252 defined at a position corresponding to a duct outlet 161 of the door duct 16, and cold air supplied through the door duct 16 is supplied to the door ice maker 253.

The ice bank 254 in which ice made by the door ice maker 253 is stored may be provided below the door ice maker 253. The ice bank 254 may be provided with a crushing device 255 for crushing the discharged ice. An ice chute 26 communicating with a dispenser 24 may be formed at the lower end of the ice bank 254.

The dispenser 24 may be provided on the front surface of the freezing compartment door 21. The dispenser 24 may be configured to take out purified water or ice from the outside while the freezing compartment door 21 is closed. The dispenser 24 may be connected to the ice bank 254 by the ice chute 26. Therefore, when the dispenser 24 is operated, the ice stored in the ice bank 254 may be taken out.

Hereinafter, the structure of the grille pan 15 will be described in more detail with reference to the drawings.

Figure 4:
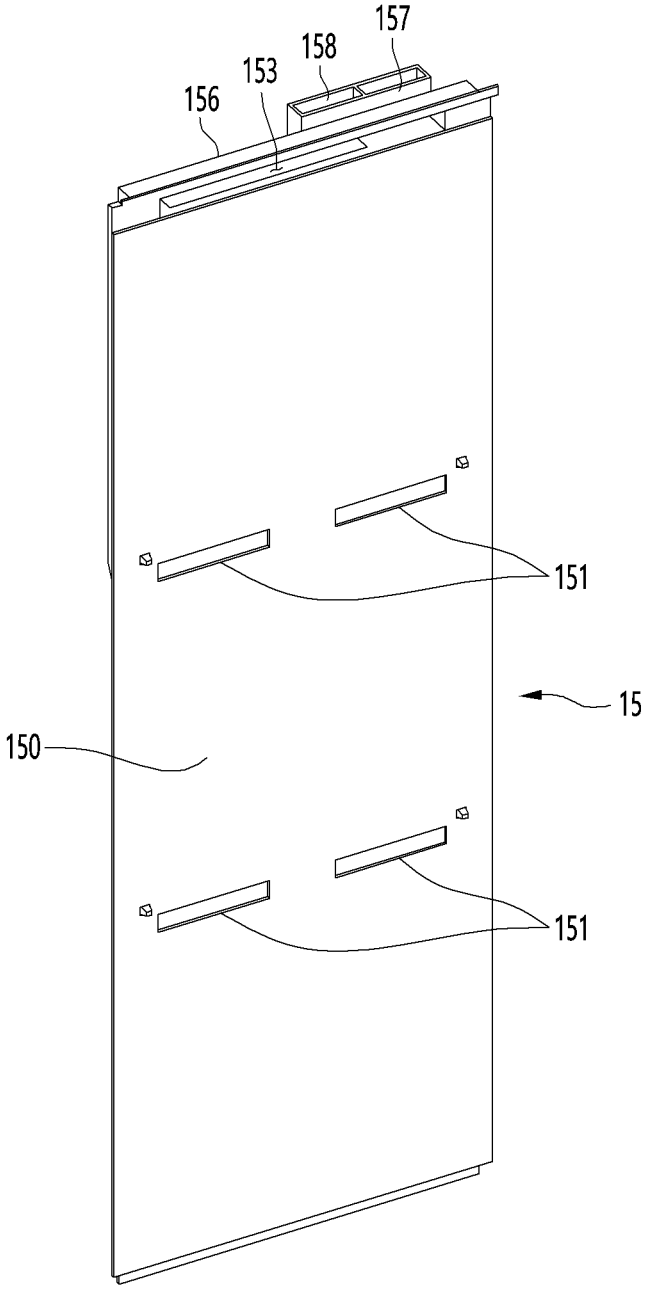
FIG. 4 is a front perspective view of an example grille pan according to an implementation of the present disclosure.
Figure 5:
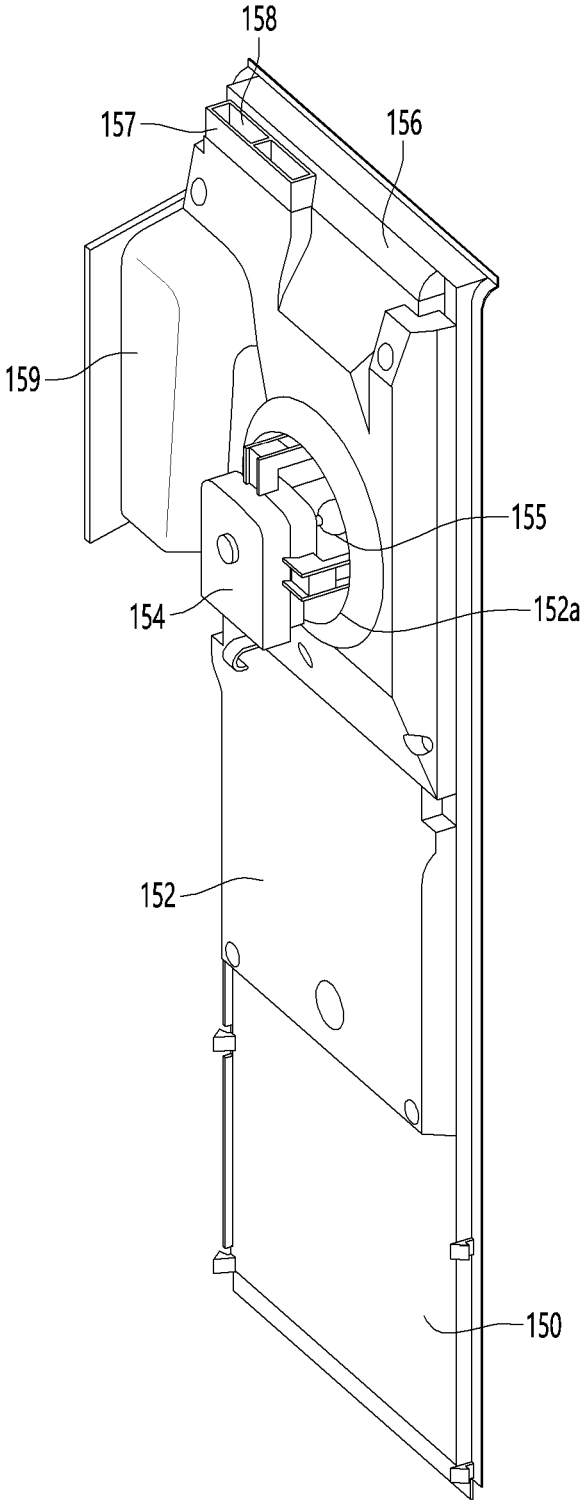
FIG. 5 is a rear perspective view of the grille pan in FIG. 4.

FIG. 4 is a perspective view of the grille pan according to an implementation of the present disclosure, when viewed from the front. Also. FIG. 5 is a perspective view of the grille pan when viewed from the rear.

As shown in the drawing, the grille pan 15 may be mounted inside the inner case 102 defining the freezing compartment 12, and may be formed to partition the space of the freezing compartment 12 back and forth.

The grille pan 15 may include a grille plate 150 defining a front surface and a shroud 152 coupled to the rear surface of the grille plate 150.

The grille plate 150 may form at least a part of the rear wall surface of the freezing compartment 12, and a discharge port 151 through which cold air is discharged may be defined in the grille plate 150. A cold air discharge port 153 through which cold air is discharged for supplying cold air to the ice maker 40 may be defined at an upper end of the grille plate 150. The cold air discharge port 153 may be formed to have a corresponding size so that the inlet of the distribution duct 60 may be inserted thereinto.

A front guide portion 156 extending upward and forward so as to be opened downward and guide cold air forward may be formed at the upper end of the grille plate 150.

The cold air discharge port 153 may be defined on the front surface of the front guide portion 156. At least a part of the inner surface of the front guide portion 156 may be formed in a round shape so that cold air introduced downward is directed toward the front, that is, the cold air discharge port 153.

The shroud 152 may be mounted on the rear surface of the grille plate 150, and may define a passage through which cold air generated by the evaporator 14 flows. A shroud opening 152*a* may be defined in the shroud 152, and the blowing fan 155 may be disposed inside the shroud opening 152*a*. A fan motor 154 may be provided at the rear of the shroud 152, and a rotation shaft of the fan motor 154 may be connected to the blowing fan 155. The blowing fan 155 is rotated inside the shroud 152 so that cold air generated by the evaporator 14 is introduced into the shroud 152 and then discharged.

The opened upper end of the shroud 152 may communicate with the front guide portion 156 disposed at the upper end of the grille plate 150. Therefore, cold air forcedly flowed by the blowing fan 155 may pass through the upper end of the shroud 152, may be guided forward by the front guide portion 156, and may be discharged to the cold air discharge port 153.

An upper guide portion 157 extending upward may be formed in the shroud 152. The upper guide portion 157 may be formed at a position shifted to one of the left and right sides, and may be located at a position corresponding to the door duct 16.

The upper guide portion 157 may be formed separately from the front guide portion 156, and may extend further upward than the upper end of the front guide portion 156. The upper guide portion 157 may define a passage having an opened upper surface. The lower surface of the upper guide portion 157 may communicate with the inside of the shroud 152, and the upper surface of the upper guide portion 157 may communicate with the door duct 16. An opened upper discharge port 158 may be defied at the upper end of the upper guide portion 157, and the upper discharge port 158 may be connected to a duct inlet 162 of the door duct 16. Therefore, a part of cold air forcedly flowed by the blowing fan 155 may flow into the door duct 16 along the upper guide portion 157.

A damper mounting portion 159 may be formed at one end of the shroud 152. The damper mounting portion 159 may be formed on a side adjacent to the refrigerating compartment 13, and a damper may be provided therein. One surface of the damper mounting portion 159 may be opened to be connected to the opened one side of the barrier 11, and may communicate with the refrigerating compartment 13. Therefore, a part of cold air forcedly flowed by the blowing fan 155 according to the opening and closing of the damper may flow into the refrigerating compartment 13 through the damper mounting portion 159.

Hereinafter, the internal structure of the freezing compartment 12 and the arrangement structure of the ice maker assembly 30 will be described in more detail with reference to the drawings.

Figure 6:
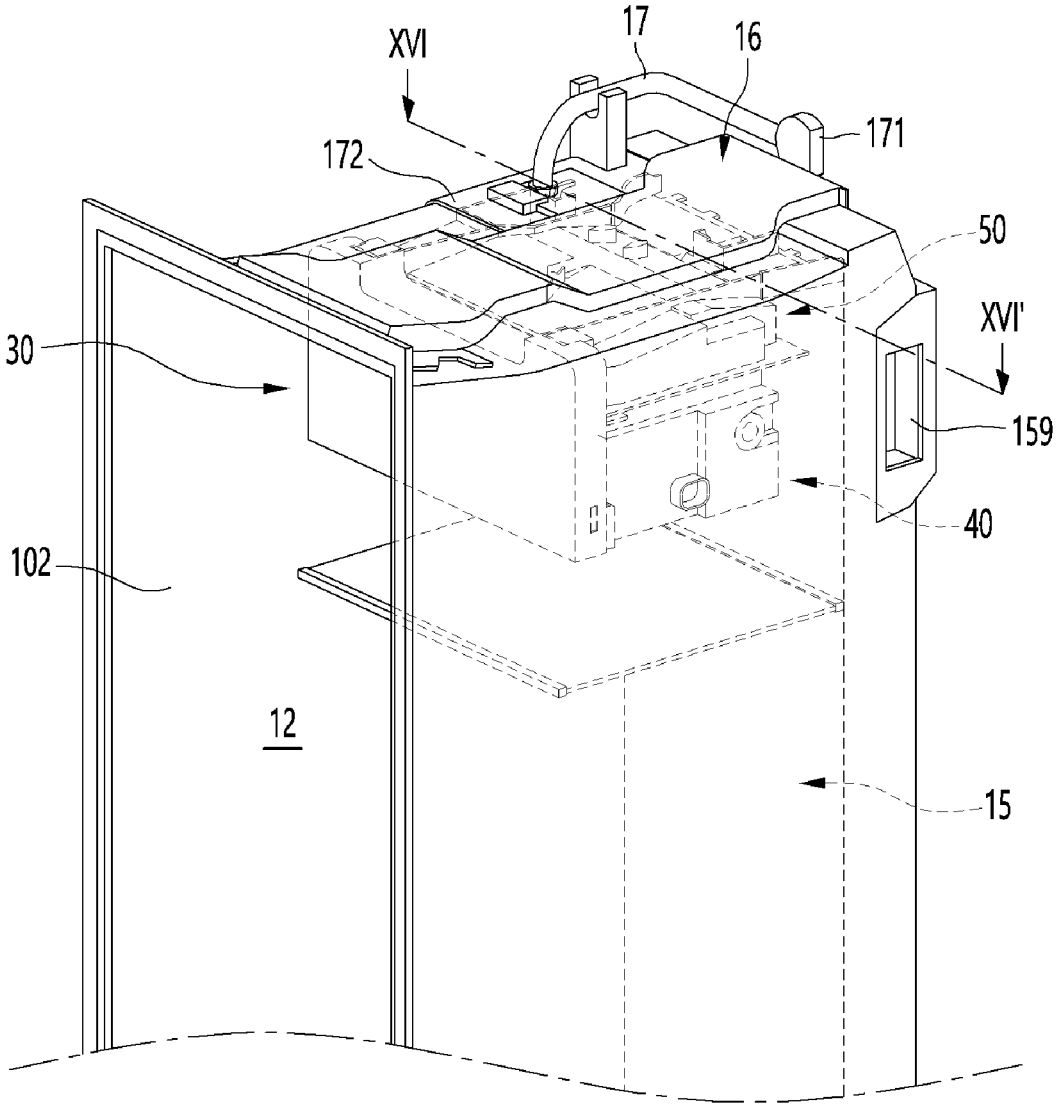
FIG. 6 is a partial perspective view illustrating an arrangement structure of an ice maker assembly and an arrangement of a door duct and a guide tube disposed in an inner case of the freezing compartment, according to an implementation of the present disclosure.
Figure 7:
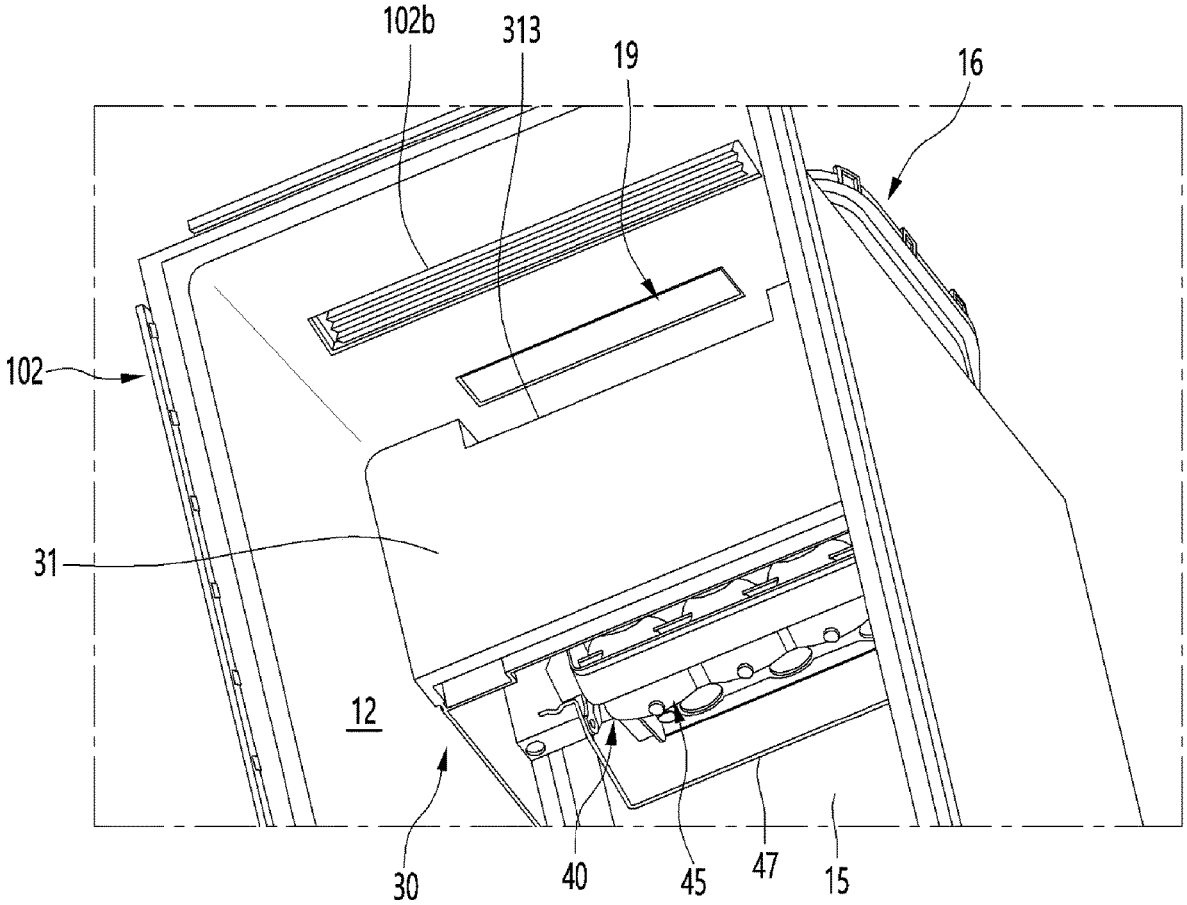
FIG. 7 is a partial perspective view of the inside of the freezing compartment in which the ice maker assembly is mounted, as viewed from below.
Figure 8:
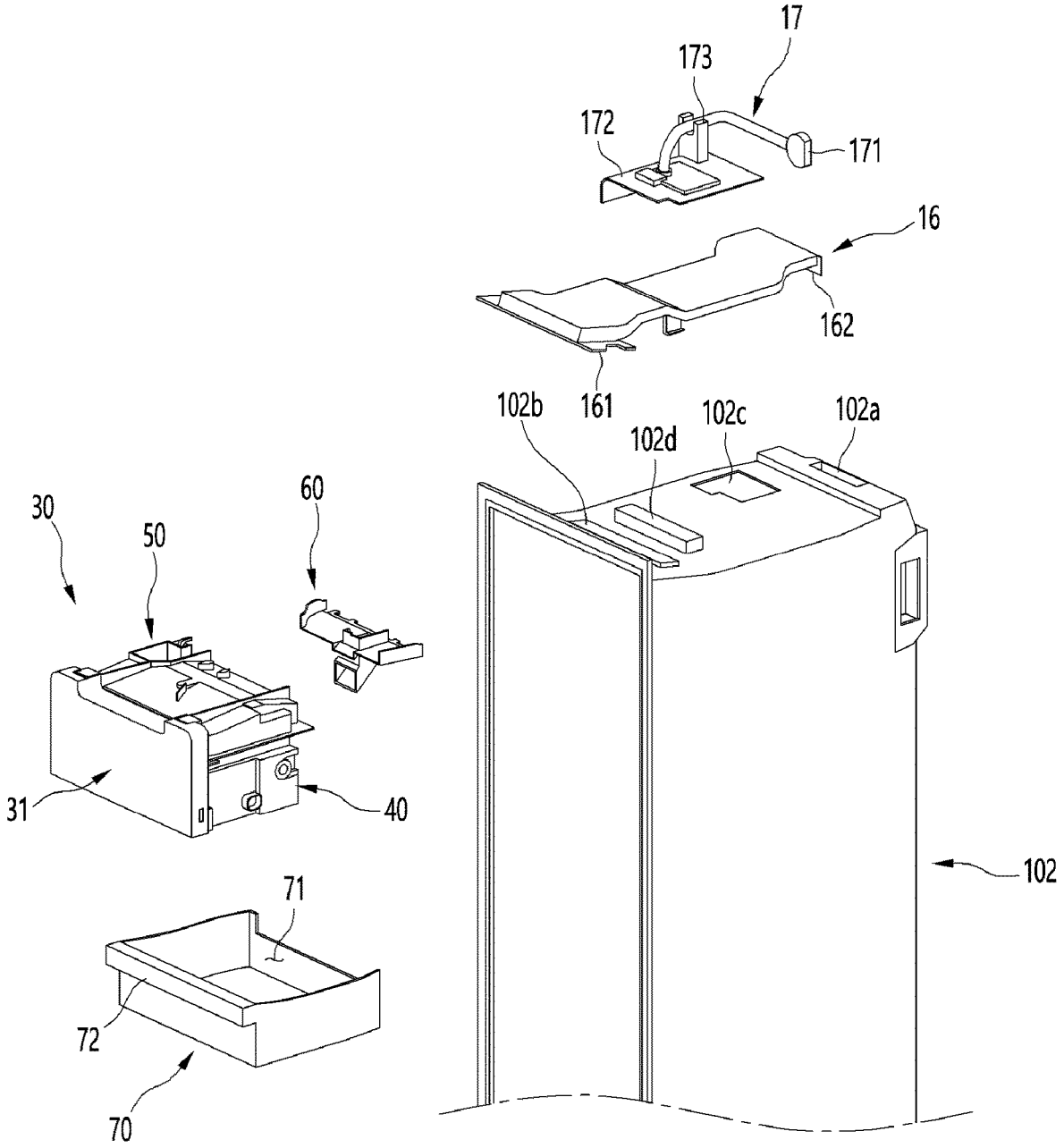
FIG. 8 is an exploded perspective view illustrating the coupling structure of the ice maker assembly, the door duct, and a guide tube.

FIG. 6 is a partial perspective view illustrating the arrangement structure of the ice maker assembly and the arrangement of the door duct and the guide tube disposed in the inner case of the freezing compartment, according to an implementation of the present disclosure. Also. FIG. 7 is a partial perspective view of the inside of the freezing compartment in which the ice maker assembly is mounted, as viewed from below. Also, FIG. 8 is an exploded perspective view illustrating the coupling structure of the ice maker assembly, the door duct, and the guide tube.

As shown in the drawings, an upper surface inlet 102*a* and an upper surface outlet 102*b* may be defined on the upper surface of the inner case 102 defining the upper surface of the freezing compartment 12. The upper surface inlet 102*a* may be opened to communicate with the space in which the evaporator 14 is disposed, and the upper surface outlet 102*b* may be opened at the front end of the upper surface of the freezing compartment 12. The upper surface outlet 102*b* may be located at an upper side facing the door ice maker cover 251 in a state in which the freezing compartment door 21 is closed.

The door duct 16 may be provided on the upper surface of the inner case 102. The door duct 16 may be elongated in the front-and-rear direction, the front end and the rear end of the door duct 16 may be opened, and a passage through which cold air flows may be defined therein. The door duct 16 may be buried in the heat insulating material 103 in a state of being mounted to the inner case 102.

The duct outlet 161 and the duct inlet 162 may be defined at the front end and the rear end of the door duct 16, respectively. The duct inlet 162 may communicate with the upper discharge port 158 exposed through the upper surface inlet 102*a*, and the duct outlet 161 may communicate with the upper surface outlet 102*b*. Therefore, a part of the cold air generated by the evaporator 14 may be supplied to the door ice maker 253 through the door duct 16.

An illumination mounting portion 102*d* to which the illumination device 19 is mounted may be further defined on the upper surface of the inner case 102. The illumination mounting portion 102*d* may be located in front of the ice maker assembly 30 to illuminate the inside of the freezing compartment 12.

A water supply pipe opening 102*c* may be defined on the upper surface of the inner case 102. The water supply pipe opening 102*c* may be opened above a water supply member 49 to be described below, and a water supply pipe 174 may pass toward the ice maker 40.

A guide tube 17 may define a passage through which the water supply pipe 174 for supplying water to the ice maker 40 is guided. Both ends of the guide tube 17 may be provided with a front bracket 172 and a rear bracket 171.

The front bracket 172 may be in close contact with the upper surface of the inner case 102, and may shield the water supply pipe opening 102*c*. The end of the guide tube 17 may pass through the front bracket 172 and may be opened toward the ice maker 40. A tube support 173 protruding upward to support the guide tube 17 from below may be disposed on the front bracket 172.

The rear bracket 171 may be coupled to the rear surface of the cabinet 10. The end of the guide tube 17 may be exposed to the rear surface of the cabinet 10 through the rear bracket 171. Therefore, the water supply pipe 174 disposed along the rear surface of the cabinet 10 may be introduced into the guide tube 17 through the rear bracket 171 and directed to the ice maker 40 through the front bracket 172.

The ice maker assembly 30 may be provided on the inner upper surface of the inner case 102. The ice maker assembly 30 may be located at the upper end of the freezing compartment 12, and may be spaced apart at a position higher than an accommodation member disposed at the uppermost portion of the freezing compartment 12. The ice bin 70 in which ice made by the ice maker 40 is stored may be located below the ice maker assembly 30. The ice bin 70 may define an ice accommodation space 71 having an opened upper surface, and may be seated on the accommodation member such as a shelf. An empty handle 72 may be formed on the front surface of the ice bin 70 so that the ice bin 70 can be pulled out or lifted and moved.

A horizontal width of the ice maker assembly 30 may be formed to correspond to a horizontal width of the freezing compartment 12. Therefore, in a state in which the ice maker assembly 30 is mounted, the cold air discharge port 153 and the distribution duct 60 provided at the rear of the ice maker assembly 30 may be covered by the ice maker assembly 30. In particular, when viewed from the front of the freezing compartment, only the front cover 31 may be exposed, and all rear components may be shielded by the front cover 31.

The ice maker assembly 30 may include an ice maker 40 for making ice, an ice maker cover 50 for shielding the upper surface of the ice maker 40, and a distribution duct 60 for distributing and supplying cold air to the ice maker 40. The ice maker assembly 30 may further include the front cover 31 for shielding the ice maker 40 and the ice maker cover 50 from the front.

Hereinafter, the structure of the ice maker assembly 30 will be described in more detail with reference to the drawings.

Figure 9:
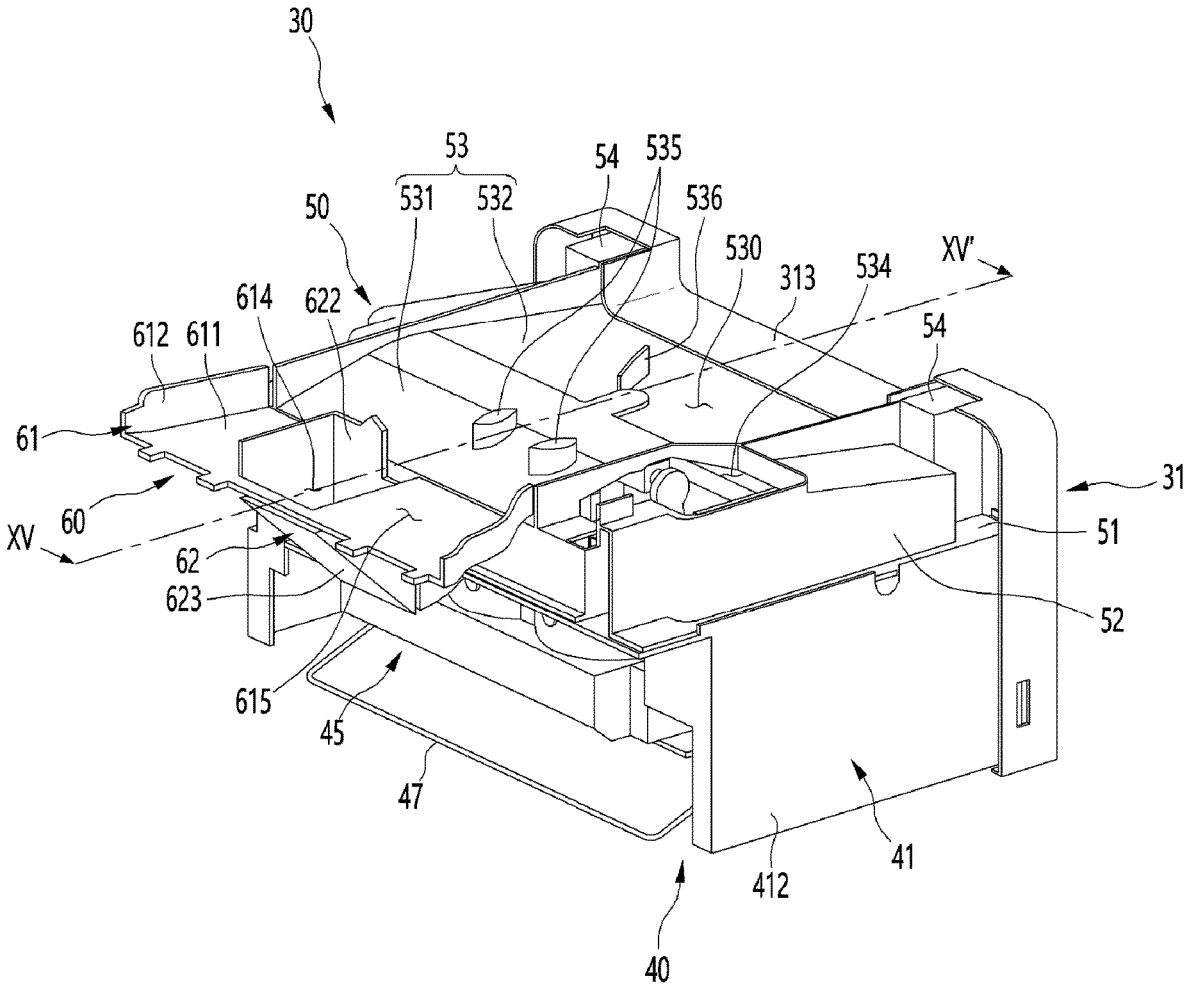
FIG. 9 is a perspective view of the ice maker assembly.
Figure 10:
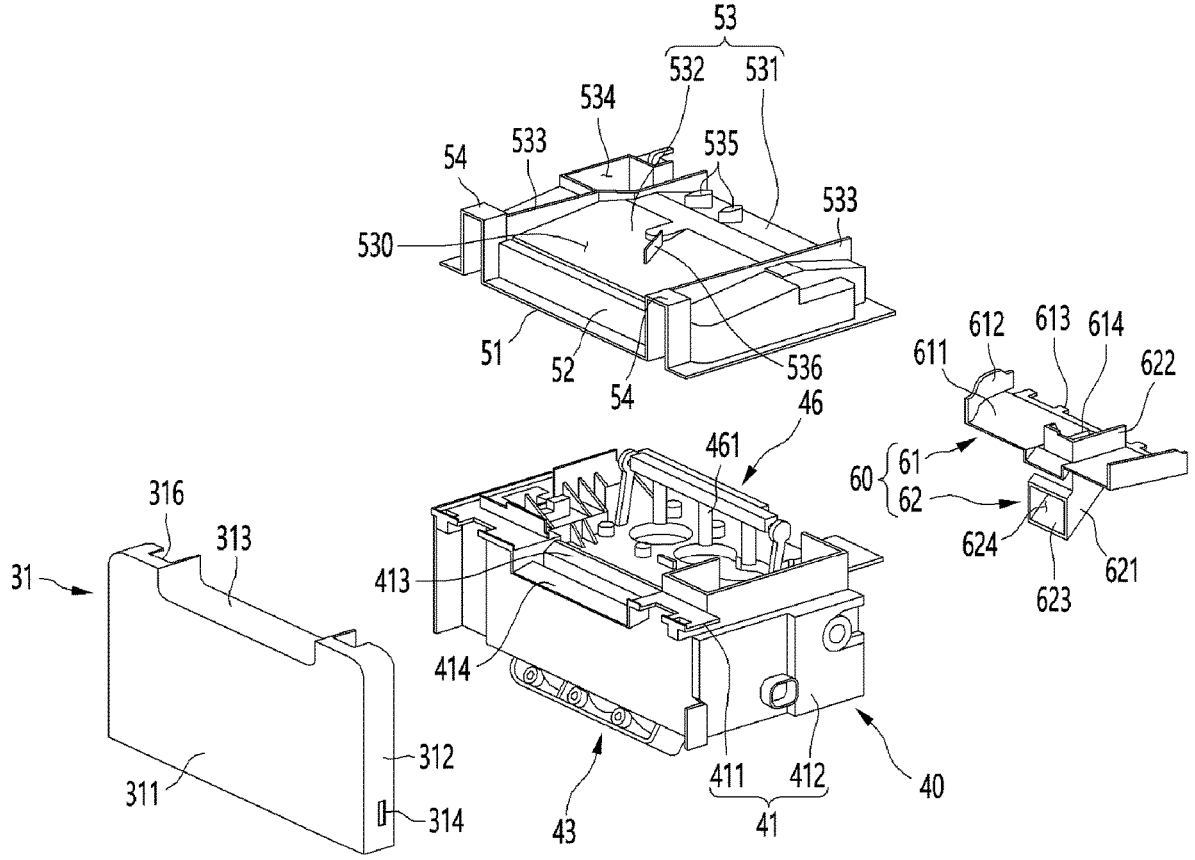
FIG. 10 is an exploded view of the ice maker assembly when viewed from the front.
Figure 11:
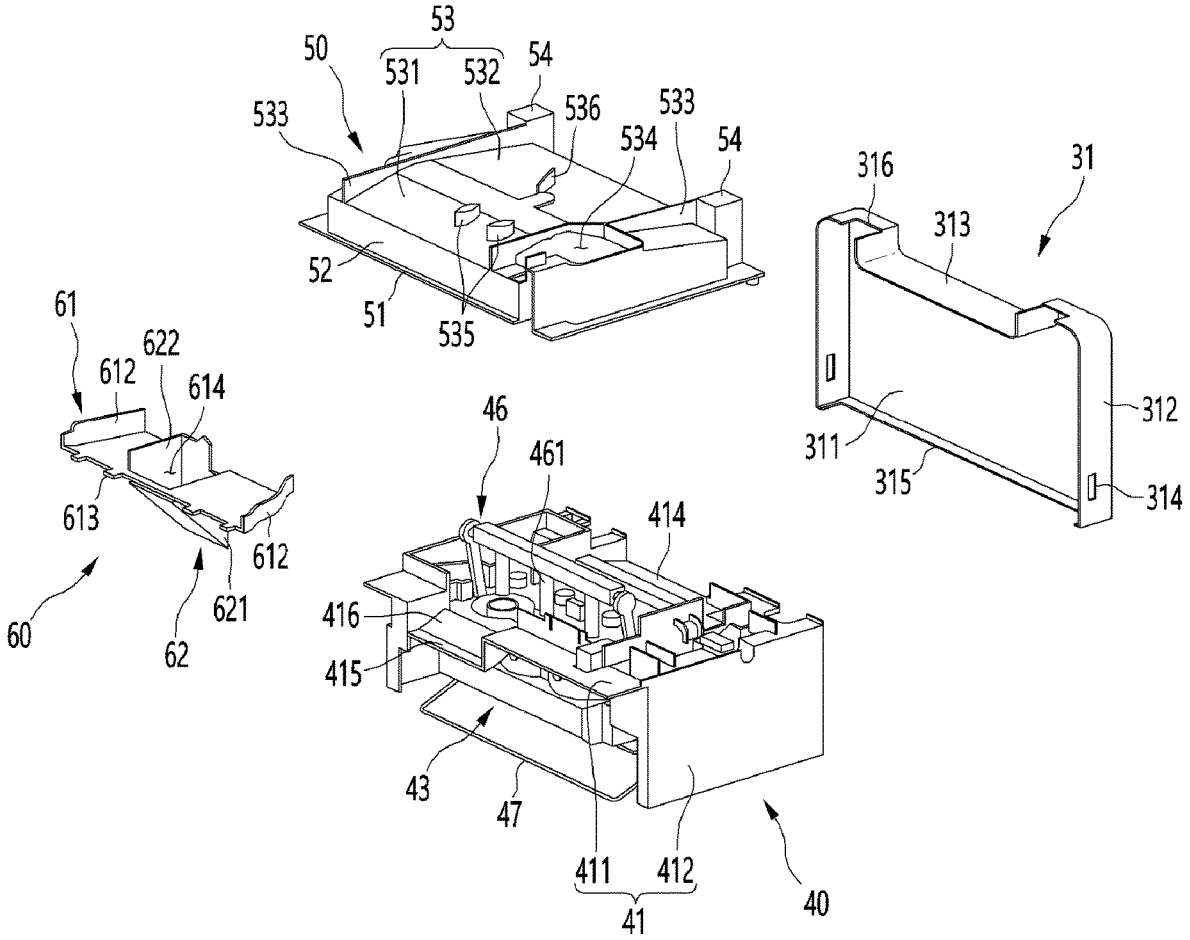
FIG. 11 is an exploded view of the ice maker assembly when viewed from the rear.

FIG. 9 is a perspective view of the ice maker assembly. Also, FIG. 10 is an exploded view of the ice maker assembly when viewed from the front. Also, FIG. 11 is an exploded view of the ice maker assembly when viewed from the rear.

As shown in the drawings, the ice maker assembly 30 may include the ice maker 40. The ice maker 40 receives automatically supplied water and makes spherical ice. The ice maker 40 may include an ice maker case 41 defining an outer appearance, an ice tray 45 in which water is accommodated for making ice, a driving device 42 for rotating the ice tray 45, an ejector 46 for separating the separated ice from the ice tray 45, and an ice full detection lever 47 for detecting whether the ice bin 70 is full.

The ice maker 40 may be referred to as a main body ice maker, a cabinet ice maker, or a spherical ice maker so as to be distinguished from the door ice maker 253.

The ice maker case 41 may include a case upper surface 411 defining the upper surface of the ice maker case 41, and a case circumferential surface 412 extending downward along the circumference of the case upper surface 411. The ice tray 45, the driving device 42, and the ice full detection lever 47 may be provided inside the space defined by the circumferential surface 412 of the case. The made ice may be separated from the ice tray 45 by the ejector 46, dropped downward, and stored in the ice bin 70.

A tray opening 442*a* communicating with the cell C in which ice is made inside the ice tray 45 may be exposed on the upper surface 411 of the case. The tray opening 442*a* may be provided in each of the plurality of cells C, and water supplied through the water supply pipe 174 may be introduced into the cell C through the tray opening 442*a*. As an ejecting pin 461 of the ejector 46 enters and exits above the tray opening 442*a*, the ice made in the cell C may be discharged.

A case inlet 415 through which cold air flows into the ice maker 40 and a case outlet 414 through which cold air flows out of the ice maker 40 through the case upper surface 411 may be defined at the front end and the rear end of the case upper surface 411.

A front cover 31 may be provided in front of the ice maker case 41. The front cover 31 defines the front surface of the ice maker assembly 30, and may shield all components disposed at the rear.

The front cover 31 may include a front portion 311 and an edge portion 312 extending rearward along the circumference of the front portion 311.

The front end of the ice maker case 41 may be inserted into the opened rear surface of the front cover 31. Case coupling portions 314 may be disposed on both left and right sides of the edge portion 312, and may be coupled to both side surfaces of the ice maker case 41.

A front discharge port 313 may be defined on the upper surface of the front cover 31, that is, on the upper surface of the edge portion 312. The front discharge port 313 may be defined by recessing the upper surface of the front cover 31 downward, and may be connected to a front end of a cover passage 530 of the ice maker cover 50 to define a passage through which cold air guided forward by the cover passage 530 is discharged.

A mounting portion accommodation groove 316 in which the cover mounting portion 54 of the ice maker cover 50 is accommodated may be further defined on the upper surface of the edge portion 312. The mounting portion accommodation groove 316 may be formed at a position corresponding to the cover mounting portion 54 in a corresponding size. The mounting portion accommodation groove 316 may be defined on both sides of the front discharge port 313 so that the cover mounting portion 54 is exposed. Therefore, a screw fastened to the ice maker case 41 passes through the cover mounting portion 54 and is fastened to the upper surface of the inner case 102 or a bracket disposed on the inner case 102 so that the ice maker assembly 30 is fixedly mounted.

The ice maker cover 50 may be provided on the upper surface of the ice maker 40 to shield the upper surface of the ice maker 40, and may define a passage of cold air that passes above the ice maker 40 and is bypassed to the front of the freezing compartment 12.

A distribution duct 60 may be provided at the rear of the ice maker 40 so that cold air discharged into the freezing compartment 12 is branched and supplied to the ice maker 40 and the ice maker cover 50.

Hereinafter, the distribution duct 60 will be described in more detail with reference to the drawings.

Figure 12:
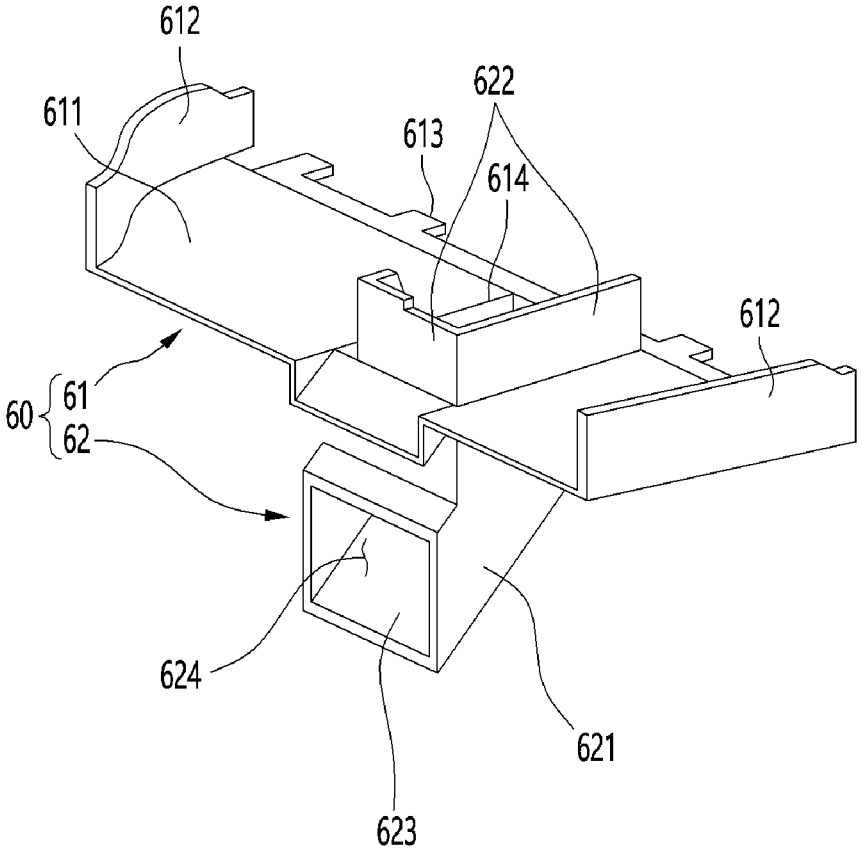
FIG. 12 is a front perspective view of a distribution duct according to an implementation of the present disclosure.
Figure 13:
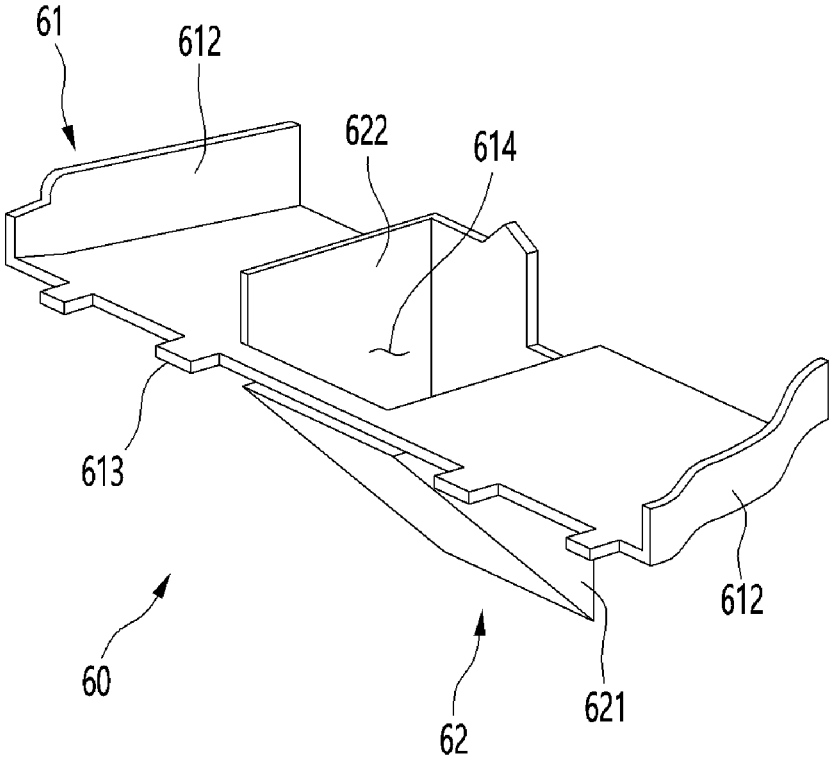
FIG. 13 is a perspective view of the distribution duct when viewed from the rear.
Figure 14:
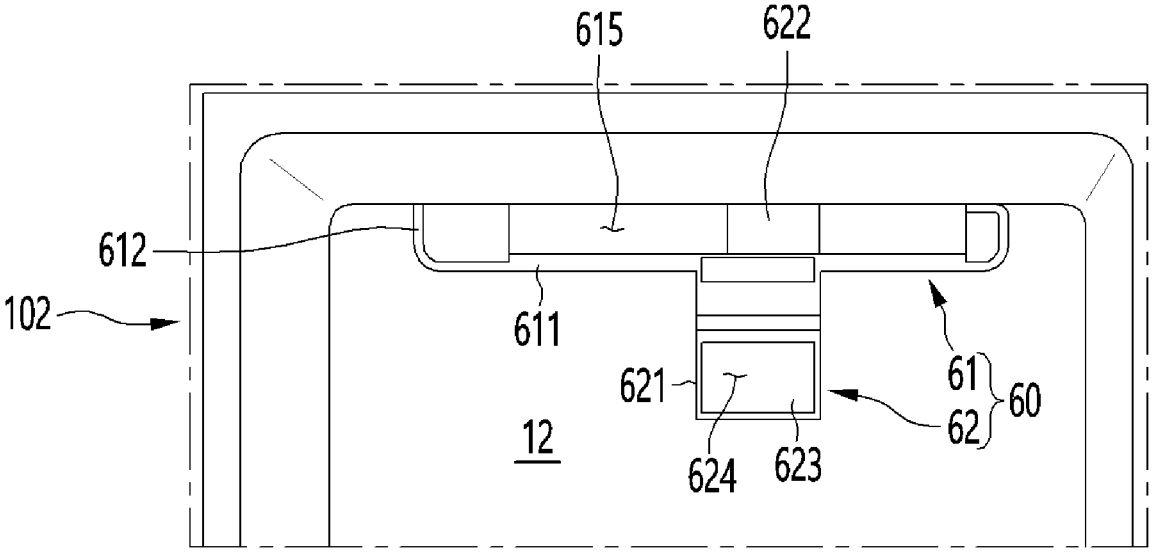
FIG. 14 is a view illustrating a state in which the distribution duct according to the implementation of the present disclosure is mounted.

FIG. 12 is a perspective view of the distribution duct according to an implementation of the present disclosure, when viewed from the front. Also, FIG. 13 is a perspective view of the distribution duct when viewed from the rear. Also, FIG. 14 is a view illustrating a state in which the distribution duct according to the implementation of the present disclosure is mounted.

As shown in the drawings, the distribution duct 60 may be provided at the rear of the ice maker 40, and may be mounted to the rear wall surface of the freezing compartment 12 or the front surface of the grille pan 15. The distribution duct 60 may connect the ice maker 40 to the cold air discharge port 153 on the rear wall surface of the freezing compartment 12, so that cold air generated by the evaporator 14 is supplied to the inside of the ice maker 40 and the ice maker cover 50. The distribution duct 60 may be in close contact with the rear wall surface and the upper surface of the freezing compartment 12.

The distribution duct 60 may include a cooling guide portion 61 and an ice making guide portion 62 as a whole. Since the cooling guide portion 61 is located above, the cooling guide portion may be referred to as an upper guide portion or a first guide portion, and may define a cooling passage 615 connected to the ice maker cover 50. Since the ice making guide portion 62 is located below the cooling guide portion 61, the ice making guide portion 62 may be referred to as a lower guide portion or a second guide portion, and may define an ice making passage 624 connected to the inside of the ice maker case 41.

In detail, the cooling guide portion 61 may include a guide portion base 611 and a guide portion side 612. The guide portion base 611 may define the bottom surface of the cooling guide portion 61, and may be formed in a plate shape. The rear end of the guide portion base 611 may be formed to correspond to or be larger than the width of the cold air discharge port 153 at the rear of the freezing compartment 12, and may be formed to be narrower as the rear end of the guide portion base 611 extends forward. The front end of the guide portion base 611 may be formed to have a width corresponding to the inlet of the cover passage 530 defined on the upper surface of the ice maker cover 50, and may be connected to the inlet of the cover passage 530.

A plurality of base protrusions 613 extending rearward may be disposed at the rear end of the guide portion base 611. A plurality of base protrusions 613 may be spaced apart from each other along the rear end of the guide portion base 611, and thus a base groove may be defined between the base protrusions 613. The rear end of the base protrusion 613 may be inserted into the cold air discharge port 153, and may be supported at the inside of the grille pan 15. Therefore, cold air flowing from the lower side to the upper side may flow into the cooling guide portion 61 through the base groove between the base protrusions 613.

The guide portion side 612 may extend upward from both left and right ends of the guide portion base 611. The guide portion side 612 may extend to contact the upper surface of the inner case 102, and the cooling passage 615 may be defined between the inner case 102 and the guide portion base 611. The guide portion side 612 may be connected to the sidewall 533 formed in the cover passage 530, so that the cooling passage 615 and the cover passage 530 communicate with each other.

A base opening 614 may be defined at the center of the guide portion base 611. The base opening 614 may communicate with the ice making guide portion 62, and may serve as the inlet of the ice making passage 624. Therefore, the base opening 614 may be referred to as an ice making passage inlet.

A vertical extension portion 622 extending upwardly may be defined along the circumference of the base opening 614. The vertical extension portion 622 guides cold air flowing into the cooling guide portion 61 toward the ice making guide portion 62, and may be defined along the front surface and one side surface of the base opening 614. The vertical extension portion 622 may be integrally formed with the ice making guide portion 62, or may be formed in a shape extending upward through the base opening 614.

Therefore, a part of cold air flowing into the cooling guide portion 61 may be directed toward the ice making guide portion 62 by the vertical extension portion 622, and may be supplied into the ice maker 40.

The ice making guide portion 62 may communicate with the base opening 614 and extend downward from the base opening 614, and may extend up to the inlet of the ice maker case 41. That is, in a state in which the distribution duct 60 and the ice maker 40 are mounted, the ice making guide portion 62 may communicate with the inside of the ice maker 40.

In detail, the ice making guide portion 62 may be provided with a duct extension portion 621 extending downward, and the duct extension portion 621 may define an ice making passage 624 communicating with the base opening 614 therein. In addition, the opened lower surface of the duct extension portion 621 may be opened toward the front, and the outlet of the ice making passage 624 may communicate with the case inlet 415.

The duct extension portion 621 may extend downward and forward. An extension portion inclination surface 623 directed forward to face downward may be disposed inside the duct extension portion 621. Therefore, cold air flowing through the inlet of the ice making guide portion 62 may smoothly flow to the ice maker 40 through the duct extension portion 621.

The duct extension portion 621 may extend to be inserted into the case inlet 415. Therefore, cold air flowing through the ice making passage 624 may be effectively supplied into the ice maker 40. The ice making guide portion 62 may be formed to be narrower than the width of the cooling guide portion 61 to supply cold air to a specific area of the ice maker 40 below.

Hereinafter, the structure of the ice maker 40 and the flow of cold air in the ice maker 40 will be described in more detail.

Figure 15:
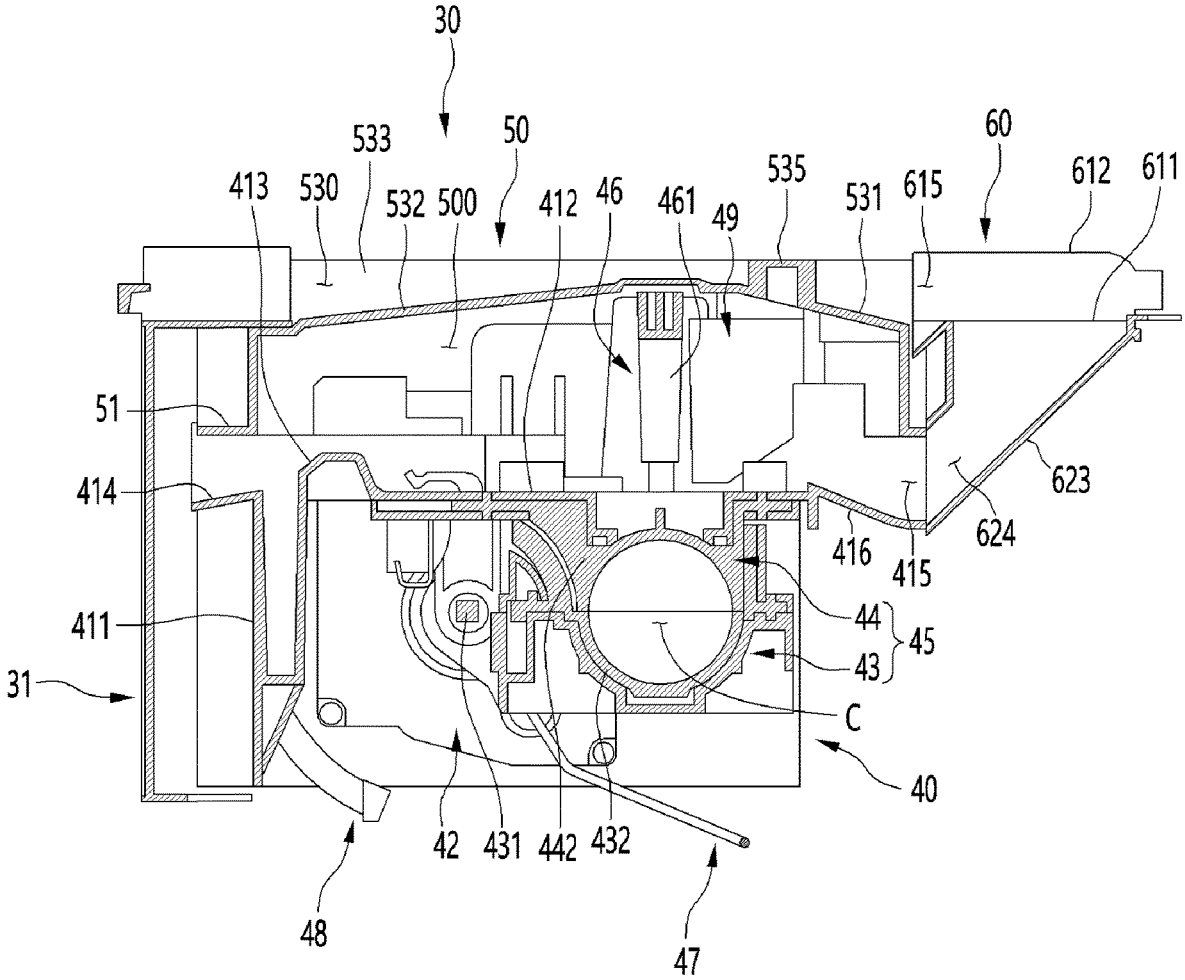
FIG. 15 is a cross-sectional view of the ice maker assembly.
Figure 16:
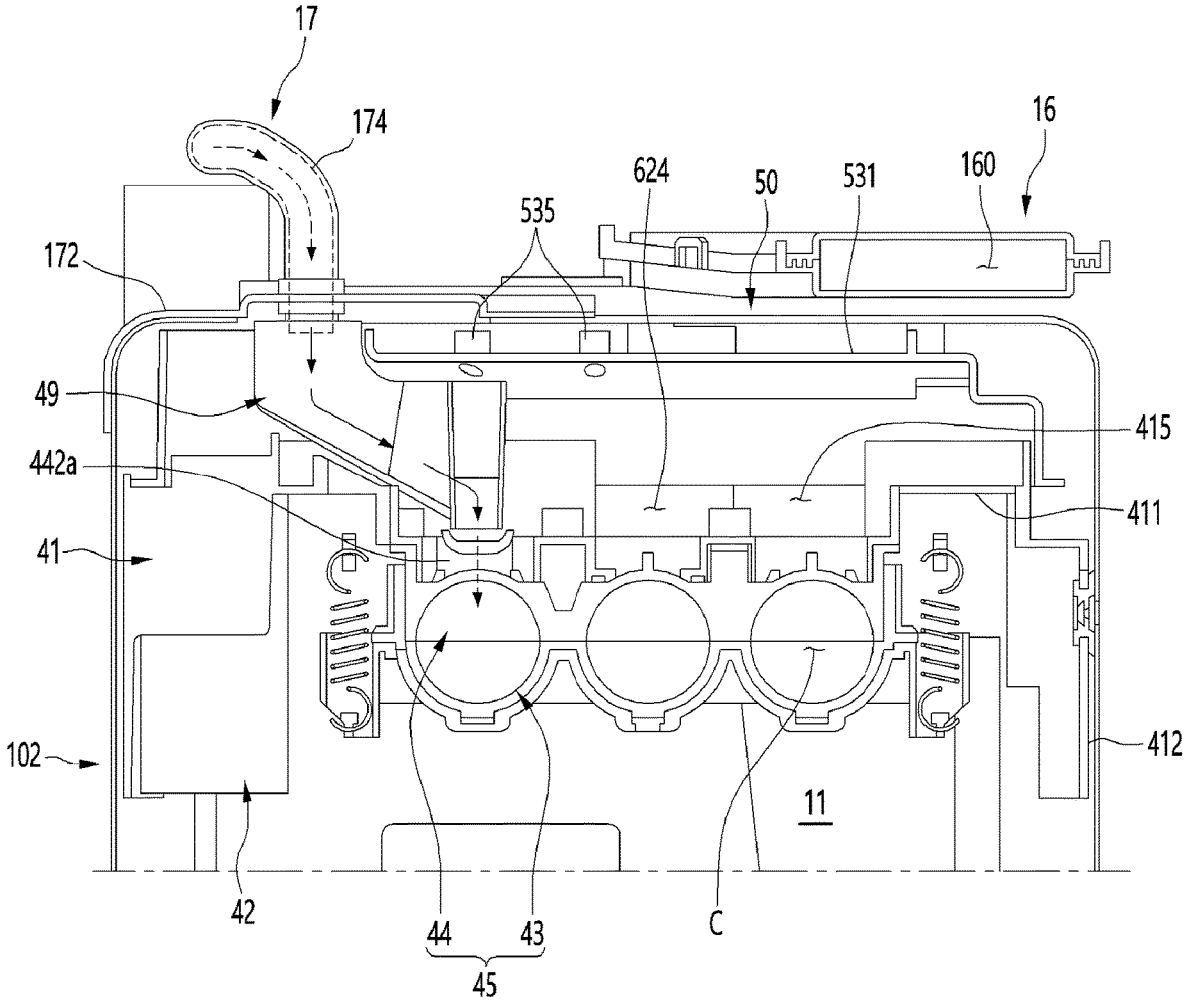
FIG. 16 is a cross-sectional view illustrating a structure for supplying water to the ice maker.
Figure 17:
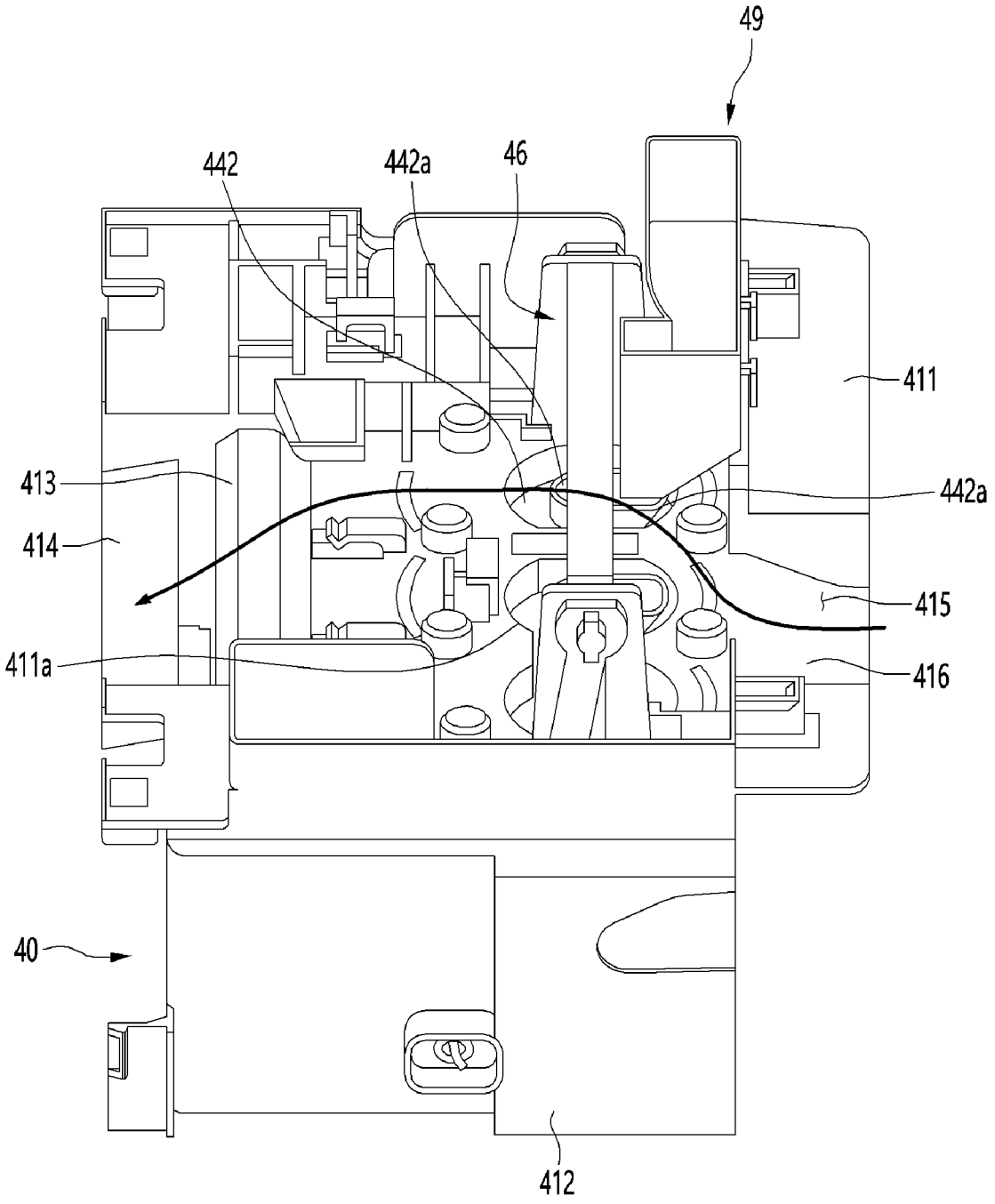
FIG. 17 is a perspective view of the ice maker.

FIG. 15 is a cross-sectional view of the ice maker assembly and is a cross-sectional view taken along line XV-XV' of FIG. 9. Also, FIG. 16 is a cross-sectional view illustrating a structure for supplying water to the ice maker and is a cross-sectional view taken along line XVI-XVI' of FIG. 6. Also, FIG. 17 is a perspective view of the ice maker.

As shown in the drawings, the ice maker 40 may include an ice maker case 41 and an ice tray 45 provided inside the ice maker case 41. An ice maker cover 50 may be provided on the upper surface of the ice maker case 41, and the ice maker cover 50 may define a cooling space 500 of the ice maker 40 and a space through which cold air bypasses above the ice maker 40. In addition, in a state in which the ice maker cover 50 is mounted, the front cover 31 is mounted on the front of the ice maker 40 to shield the ice maker 40 from the front. A distribution duct 60 may be provided at the rear of the ice maker 40 in a state in which the ice maker cover 50 is mounted, and cold air branched by the distribution duct 60 may be branched and supplied to the space inside the ice maker 40 and the space above the ice maker cover 50.

The structure of the ice maker 40 will be described in more detail. The ice maker 40 may be provided with an ice tray 45 disposed inside the ice maker case 41. The ice tray 45 may include a plurality of cells C in which water is accommodated and ice can be made. For example, the cell C may be formed in a spherical shape, and thus the ice maker 40 may be configured to make spherical ice.

The ice tray 45 may include an upper tray 44 and a lower tray 43. A plurality of cells C inside the ice tray 45 may be continuously disposed. In this case, the cells C may be disposed horizontally or vertically according to the arrangement direction of the ice tray 45. For example, as shown in FIG. 16, the plurality of the cells C may be continuously disposed in the horizontal direction, and the ice tray 45 may be disposed in the horizontal direction (left-and-right direction). Of course, the ice tray 45 may be disposed in the front-and-rear direction according to the size and arrangement of the space in which the ice maker assembly 30 is disposed.

The upper tray 44 may be fixedly mounted on the upper surface 411 of the case, and at least a part of the case upper surface 411 may be exposed. The upper tray 44 may be provided with an upper mold 442 defining the upper portion of the cell C therein, and the upper mold 442 may be made of a silicone material. A tray opening 442*a* opened to communicate with the cell C may be defined at the upper end of the upper mold 442. The ejecting pin 461 may enter and exit through the tray opening 442*a* to separate the made ice, and water may be supplied by the water supply member 49.

The water supply member 49 may be provided at a position corresponding to the cell C formed at one end of the plurality of cells C continuously disposed in the horizontal direction. Therefore, water supplied through the water supply member 49 may be introduced through one cell C, and may sequentially fills the plurality of cells C continuously disposed in the horizontal direction.

In particular, the water supply member 49 may extend to protrude further laterally than the ice tray 45, and the water supply member 49 may be positioned at a position corresponding to the end of the water supply pipe 174 located on one side of the upper surface of the inner case 102. The bottom surface of the water supply member 49 is inclined so that water is smoothly supplied to the tray opening of the upper end of the cell C.

The lower tray 43 may be provided below the upper tray 44, and may be rotatably mounted by a driving device 42 including a combination of a motor and a gear. A lower mold 432 defining the lower portion of the cell C may be disposed inside the lower tray 43. When the lower tray 43 and the upper tray 44 are coupled to each other and closed, the upper mold 442 and the lower mold 432 contact each other to form the spherical cell C and ice can be made.

A driving device 42 may be provided on one side of the ice maker case 41, and the driving device 42 may be connected to the rotation shaft 431 of the lower tray 43 to rotate the lower tray 43. An ice full detection lever 47 capable of detecting whether the inside of the ice bin 70 is full may be connected to the driving device 42. The ice full detection lever 47 may be operated when the driving device 42 is driven, and may be linked with the operation of the lower tray 43.

A lower ejector 48 may be provided on the rear surface of the ice maker case 41. The lower ejector 48 may be located on the trajectory of the lower tray 43 and may protrude forward. Therefore, when the lower tray 43 rotates after ice is made in the ice tray 45, the lower tray 43 may press the lower mold 432 to separate the ice from the lower tray 43.

The ice tray 45 may be accommodated inside the ice maker case 41, and ice may be made inside the cell C by cold air supplied into the ice maker 40.

To this end, the ice making guide portion of the distribution duct 60 may communicate with a space 500 defined by the coupling of the ice maker case 41 and the ice maker cover 50, and cold air introduced through the ice making guide portion 62 may cause ice making while passing through the ice maker 40.

In detail, a downwardly recessed case outlet 414 may be defined at the front end of the case upper surface 411. A front guide 413 that rises toward the rear may be disposed on the lower surface of the case outlet 414. The front guide 413 may be inclined or rounded, and cold air passing through the case upper surface 411 is guided to smoothly flow to the case outlet 414.

A downwardly recessed case inlet 415 may be defined at the rear end of the case upper surface 411. A rear guide 416 that rises toward the front may be disposed on the lower surface of the case inlet 415. The case inlet 415 may be connected to the distribution duct 60 to serve as an inlet through which cold air is introduced toward the ice maker 40.

Therefore, cold air flowing into the case inlet 415 may flow forward while being directed upward through the rear guide 416, may flow forward while being directed downward through the front guide 413, and may be discharged to the case outlet 414. That is, cold air supplied to pass through the case upper surface 411 passes through the upper position separated from the case upper surface 411. Therefore, it is possible to ensure smooth flow of cold air and minimize interference with components protruding upward from the case upper surface 411.

Of course, a part of cold air flowing to the case upper surface 411 may flow into the ice maker case 41 through a plurality of openings defined on the case upper surface 411, such as the tray opening 442*a* and the opening through which the ejector 46 passes, and may cool the ice tray 45 located inside the ice maker case 41 as a whole.

Cold air guided above the ice maker cover 50 through the cooling guide portion 61 of the distribution duct 60 may be discharged into the space in front of the ice maker assembly 30 through the ice maker cover 50, without flowing into the ice maker 40.

Hereinafter, the ice maker cover 50 will be described in more detail with reference to the drawings.

Figure 18:
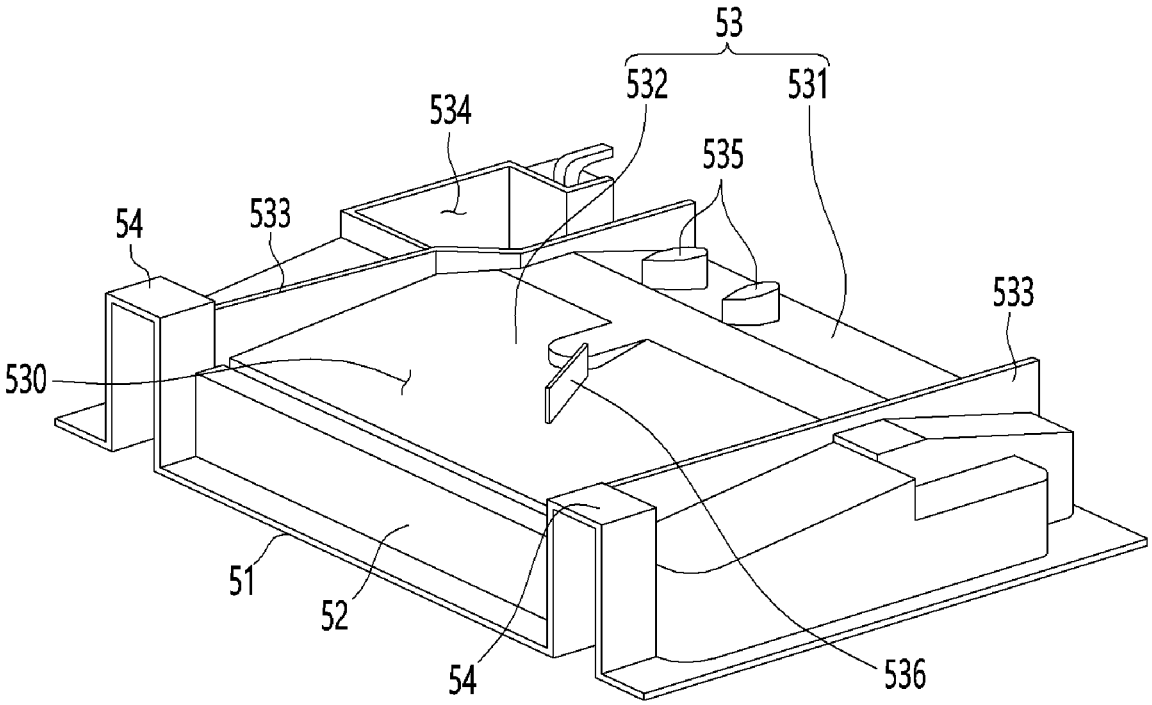
FIG. 18 is a perspective view of an ice maker cover according to an implementation of the present disclosure, when viewed from the front.
Figure 19:
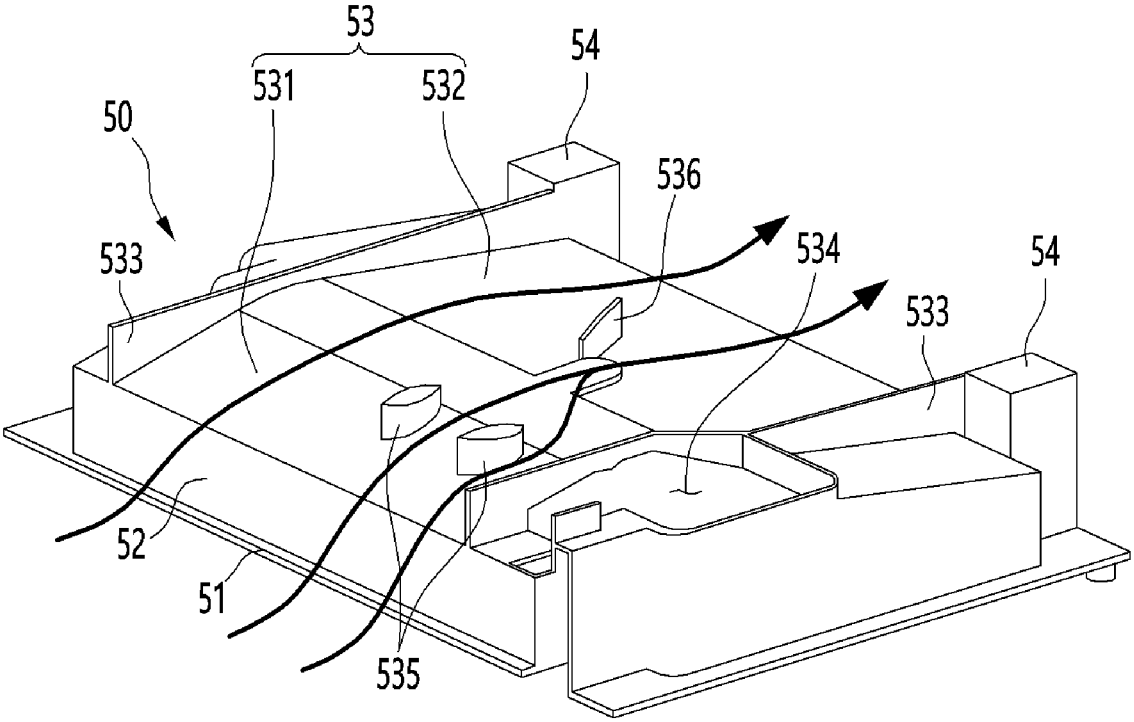
FIG. 19 is a perspective view of the ice maker cover when viewed from the rear.

FIG. 18 is a perspective view of the ice maker cover according to an implementation of the present disclosure, when viewed from the front. Also, FIG. 19 is a perspective view of the ice maker cover when viewed from the rear.

As shown in the drawings, the ice maker cover 50 may be formed to shield the upper surface of the ice maker 40. The ice maker cover 50 may be disposed on the upper surface of the freezing compartment 12, that is, between the inner case 102 and the ice maker 40 in a state in which the ice maker assembly 30 is mounted.

The ice maker cover 50 may shield the ice maker 40 from above, and may further define a cold air passage, which is separated from the inside of the ice maker 40, above the ice maker 40. Therefore, cold air supplied by the distribution duct 60 may be guided by the ice maker cover 50 without passing through the ice maker 40, and may be supplied toward the front of the ice maker assembly 30, that is, toward the front space of the freezing compartment 12 and the freezing compartment door 21.

The ice maker cover 50 may include a cover body 52 having an opened lower surface and a cover edge 51 formed along the circumference of the cover body 52.

The cover edge 51 may protrude outward from the lower end of the cover body 52, and may be in contact with the circumference of the upper surface of the ice maker case 41. When the cover edge 51 is coupled to the ice maker case 41, a space accommodating cold air introduced through the ice making guide portion 62 may be defined above the case upper surface 411.

A cover mounting portion 54 may be defined at the front end of the cover edge 51. The cover mounting portion 54 may protrude upward, and may be formed on both left and right sides of the ice maker cover 50. The cover mounting portion 54 may pass through the mounting portion accommodation groove 316 to be in contact with the upper surface of the freezing compartment 12, and may be fixedly mounted on the upper surface of the freezing compartment 12 by a screw. Therefore, the cover mounting portion 54 may be fixedly mounted on the upper surface of the freezing compartment 12 in a state in which the front cover 31 and the ice maker cover 50 are coupled to the ice maker case 41.

The cover body 52 may be coupled to the ice maker 40 so that a space to which cold air is supplied is defined above the ice maker 40. A recessed space is provided so that components above the ice maker 40, including the ejector 46, do not interfere. For example, as shown in FIGS. 11 and 15, the ice maker cover 50 may include a plurality of cover surfaces including (i) outer surfaces such as a rear guide surface 531 and a front guide surface 532 and (ii) inner surfaces that are opposite sides of the outer surfaces and face the recessed space and the ejector 46.

A guide surface 53 for guiding the flow of cold air may be defined on the upper surface of the cover body 52. Sidewalls 533 may protrude upward on both left and right sides of the guide surface 53. The sidewall 533 may have a height corresponding to the cover mounting portion 54, and may be in contact with the upper surface of the freezing compartment 12, that is, the inner case 102. Therefore, in a state in which the ice maker cover 50 is mounted, a cover passage 530 through which cold air flows may be defined by the inner case 102, the sidewall 533, and the guide surface 53.

The guide surface 53 may include a front guide surface 532 that rises from the front end of the upper surface of the cover body 52 toward the rear, and a rear guide surface 531 that rises from the rear end of the upper surface of the cover body 52 toward the front. The front guide surface 532 and the rear guide surface 531 may be formed to have the same height and may be connected to each other.

The rear guide surface 531 may be connected to the opened front end of the cooling guide portion 61, and the end of the front guide surface 532 may communicate with the front discharge port 313 of the front cover 31. Therefore, cold air supplied through the cooling guide portion 61 may sequentially pass through the rear guide surface 531 and the front guide surface 532 and may be discharged forward through the front discharge port 313. In this case, the inclined structure of the rear guide surface 531 and the front guide surface 532 enables the smooth flow of cold air.

Discharge guides 535 and 536 for guiding the flow direction of cold air passing through the cover passage 530 may be disposed on the guide surface 53. The discharge guides 535 and 536 may be respectively formed on the rear guide surface 531 and the front guide surface 532, and cold air passing through the cover passage 530 may flow with directionality.

In detail, the rear discharge guide 535 may be formed on the rear guide surface 531. The rear discharge guide 535 may be formed at an eccentric position on one of the left and right sides with respect to the center of the cover passage 530, and may be formed to protrude to a height corresponding to the height of the sidewall 533. For example, the rear discharge guide 535 may be formed in a shape of a protrusion or a rib elongated in the front-and-rear direction.

The flow of cold air flowing into the cover passage 530 may be partially restricted by the rear discharge guide 535, or the flow amount of cold air may be controlled. Therefore, more cold air may flow to the left side (in FIG. 9) where the rear discharge guide 535 is not formed among the entire regions of the rear guide surface 531.

The front discharge guide 536 may be formed on the front guide surface 532. The front discharge guide 536 may extend obliquely in one direction from the center of the front guide surface 532. Therefore, due to the front discharge guide 536, cold air guided to the front guide surface 532 through the rear guide surface 531 may flow more to the left side (in FIG. 9) among the left and right sides.

With such a structure, due to the rear discharge guide 535 and the front discharge guide 536, the flow amount of cold air passing through the cover passage 530 may increase in one direction among the left and right sides. For example, a position with a larger flow amount of cold air may be a position close to the left and right sidewalls of the refrigerator 1, and it is possible to prevent the growth of condensation or frost by preventing stagnant air at positions adjacent to the left and right sidewalls of the refrigerator 1.

A water supply port 534 may be defined on the upper surface of the ice maker cover 50. The water supply port 534 is a portion through which a water supply pipe 174 extending through the inner case 102 passes, and may be opened at a position corresponding to a water supply member 49 provided in the ice maker 40. The water supply port 534 may be defined on a portion outside the cover passage 530, that is, on the outside of the sidewall 533.

Hereinafter, the flow of cold air in the freezing compartment 12 of the refrigerator 1 having the above structure will be described with reference to the drawings.

Figure 20:
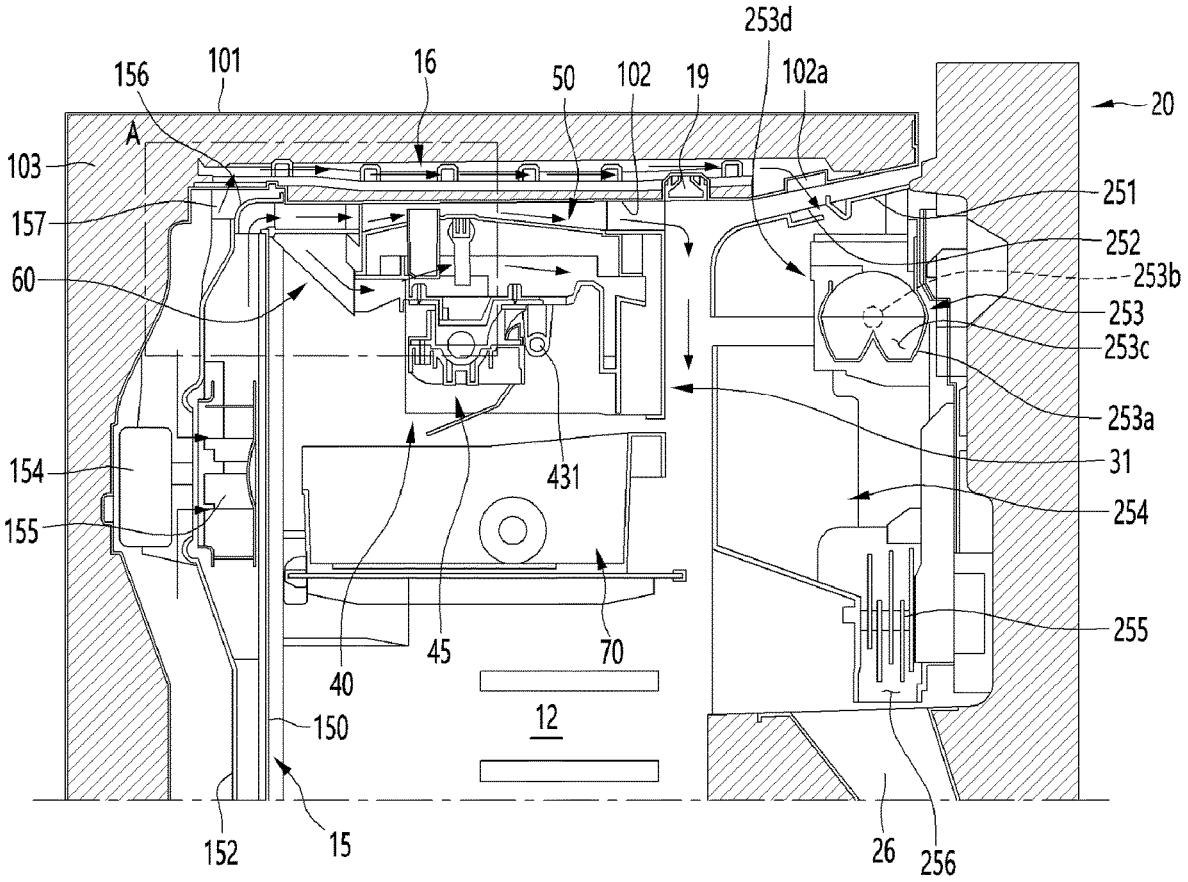
FIG. 20 is a view illustrating an example flow of cold air in the freezing compartment.
Figure 21:
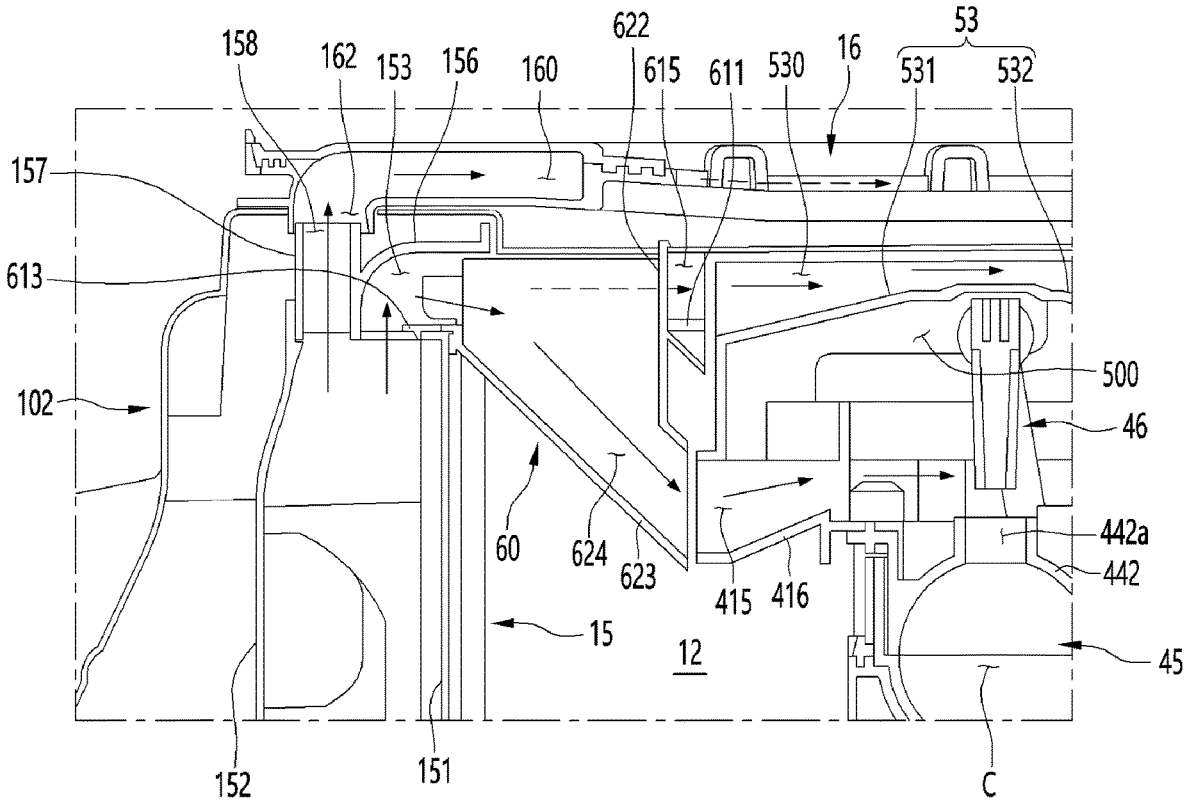
FIG. 21 unit an enlarged view of a portion A of FIG. 20.

FIG. 20 is a view illustrating the flow of cold air in the freezing compartment. Also, FIG. 21 is an enlarged view of a portion A of FIG. 20.

As shown in the drawings, cold air generated in the evaporator 14 by the rotation of the blowing fan 155 may flow upward through the shroud 152. Cold air flowing along the shroud 152 may be discharged into the freezing compartment 12 through the cold air discharge port 153 of the grille pan 15 and cool the freezing compartment 12.

A part of cold air forcibly flowed by the blowing fan 155 may be introduced into the door duct 16 and the distribution duct 60 from the upper end of the grille pan 15. In this case, the door duct 16 and the distribution duct 60 may be connected to the upper end of the grille pan 15.

That is, cold air discharged from the upper discharge port 158 along the upper end of the grille pan 15, that is, the upper guide portion 157, may flow into the door duct 16 through the duct inlet 162 of the door duct 16, may flow along the door duct passage 160 inside the door duct 16, and may be discharged toward the door ice maker cover 251 through the duct outlet 161. Cold air discharged from the door duct 16 may flow into the door ice maker 253 through the cover inlet 252 of the door ice maker cover 251, and may allow the door ice maker 253 to perform ice making.

Cold air discharged through the cold air discharge port 153 along the upper end of the grille pan 15, that is, the front guide portion 156, may flow into the distribution duct 60, and may be branched in the distribution duct 60 and supplied to the inside of the ice maker 40 and the outside of the ice maker 40.

In detail, cold air discharged from the cold air discharge port 153 on the rear wall of the freezing compartment 12 or the grille pan 15 may flow into the distribution duct 60. In this case, cold air flowing into the distribution duct 60 may be branched and supplied to the cooling guide portion 61 and the ice making guide portion 62.

A part of cold air flowing into the guide portion base 611 of the distribution duct 60 is introduced into the base opening 614 by the vertical extension portion 622, and cold air flowing into the base opening 614 may be introduced into the ice maker 40 through the ice making passage 624 of the ice making guide portion 62.

In detail, the outlet of the ice making passage 624 at the end of the ice making guide portion 62 may communicate with the case inlet 415. Therefore, cold air discharged from the ice making passage 624 may be supplied toward the ice maker 40.

Cold air flowing into the case upper surface 411 through the case inlet 415 may be supplied to the space 500 shielded by the ice maker cover 50, and may be supplied toward the ice tray 45 through the openings of the case upper surface 411. An ice making operation may be performed in the ice tray 45 by cold air supplied around the ice tray 45. Cold air passing through the ice tray 45 is discharged through the opened lower surface of the ice maker case 41, and cools the space of the freezing compartment below.

The remaining cold air except for cold air branched into the ice making guide portion 62 among cold air flowing into the cooling guide portion 61 may flow into the cover passage 530 above the ice maker cover 50 through the guide portion base 611, that is, the cooling passage 615.

Cold air flowing into the cover passage 530 may sequentially pass through the front guide surface 532 and the rear guide surface 531, and may be finally discharged into the space of the freezing compartment 12 in front of the ice maker assembly 30 through the front discharge port 313.

As such, cold air discharged into the freezing compartment 12 may be supplied to the door ice maker 253 by the door duct 16, and a part of the cold air may be supplied into the ice maker 40 by the distribution duct 60 and the ice maker cover 50. Referring to FIG. 20, a first portion of the cold air can be discharged to the door ice maker 253 via a first cold air passage P1, and a second portion of the cold air can be discharged to the ice maker 40 via a second cold air passage P2. In this manner, ice making can be performed. The remaining part of the cold air may be discharged to the space in front of the ice maker assembly 30, namely a cooling space 600, through the space between the ice maker 40 and the upper surface of the freezing compartment 12 without passing through the inside of the ice maker 40. A third portion of the cold air can be discharged to the ice maker cooling space 600 via a third cold air passage P3. The third portion of the cold air can continue to flow downward through the cooling space 600 to provide cooling to a portion of the storage space positioned vertically lower than the ice maker assembly 30.

Therefore, it is possible to evenly supply cold air to the entire inside of the freezing compartment 12 and to maintain the entire cooling performance of the freezing compartment 12 while maintaining the ice making performance. In particular, cold air may also be supplied to the upper space of the freezing compartment 12 covered by the ice maker assembly 30, that is, the space between the ice maker assembly 30 and the freezing compartment door 21.

Therefore, it is possible to ensure uniform cold air circulation and uniform temperature distribution throughout the freezing compartment 12.

In addition, cold air flowing into the cover passage 530 may be guided so that more cold air is supplied in one direction by the discharge guides 535 and 536 inside the cover passage 530. In FIG. 2, when the freezing compartment door 21 is closed, the left end of the upper portion of the freezing compartment 12 may define a cold air stagnant space blocked by the upper surface and left side surface of the freezing compartment 12, the rear surface of the freezing compartment door 21, and the door ice maker cover 251, and the ice bank 254.

However, the supply of cold air to the cold air stagnant space is guided by the discharge guides 535 and 536, and cold air is not stagnant in the cold air stagnant space and is forcibly circulated, thereby preventing the occurrence of condensation and frost in the cold air stagnant space.

As such, the passage of cold air supplied to the freezing compartment 12 when the blowing fan 155 is driven may include three passages as a whole.

In detail, cold air discharged from the upper discharge port 158 of the grille pan 15 may be supplied to the door ice maker 253 through the door duct passage 160 of the door duct 16. In this case, the distance from the upper discharge port 158 to the upper surface outlet 102*b* may be referred to as a first passage or a door ice making passage 624.

Cold air discharged from the cold air discharge port 153 of the grille pan 15 may be branched while passing through the cooling guide portion 61 of the distribution duct 60, and may be supplied to supplied to the storage space of the freezing compartment 12 in front of the ice maker assembly 30, that is, the space between the ice maker assembly 30 and the door ice maker assembly 25 through the cover passage 530 between the ice maker cover 50 and the upper surface of the inner case 102. In this case, the distance from the cold air discharge port 153 to the front discharge port 313 may be referred to as a second passage or a storage space passage.

Cold air discharged from the cold air discharge port 153 of the grille pan 15 may be branched while passing through the ice making guide portion 62 of the distribution duct 60, and may be supplied to the space between the ice maker 40 and the ice maker cover 50 through the ice making passage 624 inside the ice making guide portion 62, and ice making is performed in the ice maker 40. In this case, the distance from the cold air discharge port 153 to the outlet of the ice making passage 624 may be referred to as a third passage or an ice making passage in the refrigerator.

As such, in a state in which the ice maker 40 and the door ice maker 253 are disposed to face each other in the space at the upper end of the freezing compartment 12, cold air may be supplied through the three passages. That is, even in a state in which the ice maker assembly 30 and the door ice maker assembly 25 are densely disposed in a narrow space above the freezing compartment 12, cold air may be supplied to ensure the ice making performance of each of the ice maker 40 and the door ice maker 253, and cold air may be supplied and circulated so that cold air circulation and uniform temperature distribution in the dense upper space of the freezing compartment 12 are possible.

According to an implementation of the present disclosure, cold air for ice making may be smoothly supplied to the ice maker disposed inside the freezing compartment, and the inside of the freezing compartment may be cooled through the cover passage bypassing the ice maker.

In some implementations, the distribution duct is provided at the cold air discharge port at the rear of the ice maker, and the distribution duct is branched into the ice making guide portion supplying cold air to the ice maker and the cooling guide portion supplying cold air to pass through the ice maker cover above the ice maker.

Therefore, cold air discharged from the cold air discharge port is branched and supplied to the ice maker and the inside of the freezing compartment, so that both ice making and cooling performance may be satisfied.

In addition, even in the structure in which the ice maker is disposed to cover the cold air discharge port, cold air may be bypassed to the space in front of the ice maker through the cover passage by the ice maker cover. Therefore, cold air may be supplied to the entire region of the freezing compartment, so that the inside of the freezing compartment has a uniform temperature distribution.

When the ice maker is an ice maker that makes spherical ice, the size thereof may be somewhat large. Even when a plurality of cells for making ice are horizontally disposed, the ice maker may be disposed to fill all the horizontal spaces of the freezing compartment.

In such a structure, the cold air discharge port may be covered by the ice maker, but cold air may be supplied to the front of the ice maker through the cover passage, so that the entire freezing compartment may be evenly cooled.

In addition, the ice maker structure having a relatively large size may be disposed in the vertical direction in the freezing compartment, that is, in the direction in which the cells are disposed in the front-and-rear direction and the horizontal direction, so that the ice maker may be variously disposed according to the size of the storage space of the refrigerator.

Since the cover passage is defined between the upper surface of the ice maker cover and the upper surface of the storage space, excessive loss of space for forming the cover passage does not occur.

In addition, since the ice maker cover is coupled to the upper surface of the storage space to define the cover passage, the cover passage may be formed with a simple structure.

In addition, since the front discharge port is located on the upper surface of the storage space, the entire inside of the freezing compartment may be cooled by cold air discharged downward.

The discharge guide may be provided inside the cover passage, and cold air discharged by the discharge guide may be concentrated to one side.

Therefore, it is possible to guide the supply of cold air to the space between the rear surface of the freezing compartment door and the front surface of the freezing compartment adjacent to the rotation shaft of the door where the cold air may be structurally stagnated.

Therefore, it is possible to solve the temperature imbalance due to the cold air stagnation and to prevent the occurrence of condensation or frost due to the cold air stagnation.

When the door ice maker is provided in front of the ice maker, that is, on the rear of the door, the space between the ice maker and the door ice maker is close, and thus the supply of cold air may not be smooth. Cold air that bypasses the ice maker and is discharged forward due to the cover passage may be supplied to the space between the ice maker and the door ice maker to enable cold air circulation in a narrow space.

The ice maker and the door ice maker may be disposed at positions facing each other. In particular, the ice maker and the door ice maker are disposed at positions facing each other in the freezing compartment area where the left and right widths are narrow, so that the space inside the freezing compartment may be used more efficiently.

In addition, since the ice maker and the door ice maker are disposed at positions at which they are at least partially facing each other, a part of cold air that bypasses the ice maker and is discharged may cool the door ice maker or an area adjacent to the door ice maker, thereby providing an efficient cold air supply structure.

Since the rotation shaft of the ice maker is disposed in the horizontal direction (left-and-right direction), the protrusion of the ice maker module is minimized. Therefore, it is possible to have a structure that does not interfere with the door ice maker assembly protruding rearward even when the freezing compartment door is closed.

In addition, since the ice maker is located at the upper end of the freezing compartment and the door ice maker is disposed at the upper end of the freezing compartment door, the arrangement and connection of the water supply pipe to the ice maker and the door ice maker may be facilitated.

In the upper part of the freezing chamber, cold air discharged from the rear of the freezing compartment is branched into three passages and supplied to the door ice maker, the ice maker, and the space between the door ice may and the ice maker, cold air may be effectively distributed and supplied in the densely arranged upper space of the freezing compartment to secure ice making performance and enable uniform temperature distribution in the narrow upper space of the freezing compartment.

The above description is merely illustrative of the technical idea of the present disclosure, and various modifications and changes may be made thereto by those skilled in the art without departing from the essential characteristics of the present disclosure.

Therefore, the implementations of the present disclosure are not intended to limit the technical spirit of the present disclosure but to describe the technical idea of the present disclosure, and the technical spirit of the present disclosure is not limited by these implementations.

The scope of protection of the present disclosure should be interpreted by the appending claims, and all technical ideas within the scope of equivalents should be construed as falling within the scope of the present disclosure.

What is claimed is:

1. A refrigerator comprising:

a cabinet that defines a storage space; and an ice maker assembly provided in the storage space, the ice maker assembly comprising (i) an ice maker and (ii) an ice maker cover that is disposed at a side of the ice maker and covers a portion of the ice maker, wherein the ice maker comprises:

an ice maker case that defines an outer appearance of the ice maker, a first tray fixed to the ice maker case, a second tray configured to move between (i) a closed position in which the second tray is joined with the first tray to define an ice chamber for making ice and (ii) an open position in which the second tray is spaced apart from the first tray for separating the ice from the ice chamber, a first ejector configured to move toward the first tray, and a second ejector disposed on a trajectory of the second tray, the second ejector being configured to apply pressure to the second tray based on the second tray moving along the trajectory toward the open position, and wherein the ice maker cover covers the first tray and the first ejector, the ice maker cover comprising a plurality of cover surfaces that define a recessed space configured to accommodate at least a portion of the first ejector to thereby avoid interference between the first ejector and the ice maker cover.

2. The refrigerator of claim 1, wherein a portion of the recessed space faces the first ejector and protrudes away from the first ejector.

3. The refrigerator of claim 1, wherein the plurality of cover surfaces comprise:

a first surface that faces the first ejector in a movement direction of the first ejector; and a second surface connected to the first surface, and wherein a first distance between the first surface and the first tray in the movement direction of the first ejector is greater than a second distance between the second surface and the first tray in the movement direction of the first ejector.

4. The refrigerator of claim 1, wherein the plurality of cover surfaces comprise:

a first surface that faces the first ejector in a movement direction of the first ejector; and a second surface connected to the first surface, wherein the ice maker case has a case surface that is in contact with the first tray and spaced apart from the ice maker cover in the movement direction of the first ejector, and wherein a first distance from the case surface to the first surface in the movement direction is greater than a second distance from the case surface to the second surface in the movement direction.

5. The refrigerator of claim 1, wherein the ice maker cover defines a cover passage that is separate from an inside of the ice maker, the cover passage extending along a portion of the plurality of cover surfaces and being configured to provide at least a portion of cold air in the storage space toward a front portion of the ice maker.

6. The refrigerator of claim 1, wherein the ice maker cover comprises:

a cover edge that is coupled to the ice maker case; and a cover body that faces the ice maker case and comprises the plurality of cover surfaces that define the recessed space.

7. The refrigerator of claim 6, wherein the cover body has:

a first surface that faces the first ejector; and a second surface that is disposed between the recessed space and the cover edge.

8. The refrigerator of claim 1, wherein the first ejector comprises:

a plurality of ejecting pins that extend in a movement direction of the first ejector and are configured to move between (i) a first position for ice making and (ii) a second position for ice separation; and an ejector body that connects the plurality of ejecting pins to one another.

9. The refrigerator of claim 8, wherein the recessed space is configured to accommodate the ejector body based on the first ejector being moved from the second position to the first position.

10. The refrigerator of claim 9, wherein the plurality of ejecting pins are located closer to the first tray at the second position than at the first position.

11. The refrigerator of claim 1, wherein the first tray comprises a first mold made of a flexible material, wherein the ice maker case comprises a case surface that supports the first mold and defines an opening that exposes at least a portion of the first mold, and wherein the first ejector is configured to pass through the opening to thereby separate the ice from the first mold.

12. The refrigerator of claim 11, wherein the first ejector comprises:

a plurality of ejecting pins that extend in a movement direction of the first ejector; and an ejector body that connects the plurality of ejecting pins to one another, and wherein the recessed space is configured to accommodate the ejector body based on the plurality of ejecting pins retracting from the opening.

13. The refrigerator of claim 1, wherein the first ejector is movably disposed closer to the first tray than to the second tray, and wherein the second ejector is fixedly disposed closer to the second tray than to the first tray.

14. A refrigerator comprising:

a cabinet that defines a storage space; and an ice maker assembly provided in the storage space, the ice maker assembly comprising (i) an ice maker and (ii) an ice maker cover that is disposed at a side of the ice maker and covers a portion of the ice maker, wherein the ice maker comprises:

an ice maker case that defines an outer appearance of the ice maker, a first tray fixed to the ice maker case, a second tray configured to move between (i) a closed position in which the second tray is joined with the first tray to define an ice chamber for making ice and (ii) an open position in which the second tray is spaced apart from the first tray for separating the ice from the ice chamber, a first ejector configured to move between a first position and a second position relative to the first tray, and a second ejector configured to apply pressure to the second tray based on the second tray moving from the closed position toward the open position, and wherein the ice maker cover has (i) an inner surface that faces the first ejector and the first tray and (ii) an outer surface that is exposed to cold air guided from a rear side of the ice maker cover toward a front side of the ice maker cover, the ice maker cover defining a recessed space that is recessed outward from the inner surface toward the outer surface and configured to accommodate at least a portion of the first ejector.

15. The refrigerator of claim 14, wherein the ice maker cover comprises a plurality of cover surfaces that define the recessed space.

16. The refrigerator of claim 15, wherein the plurality of cover surfaces comprise:

a first surface that faces the first ejector in a movement direction of the first ejector; and a second surface connected to the first surface, and wherein a first distance between the first surface and the first tray in the movement direction of the first ejector is greater than a second distance between the second surface and the first tray in the movement direction of the first ejector.

17. The refrigerator of claim 14, wherein the ice maker defines at least one front discharge port configured to discharge forward the cold air to a front portion of the ice maker.

18. The refrigerator of claim 14, wherein the first ejector comprises:

a plurality of ejecting pins that extend in a movement direction of the first ejector; and an ejector body that connects the plurality of ejecting pins to one another, and wherein the recessed space is configured to accommodate the ejector body based on the first ejector moving from the second position to the first position.

19. An ice maker assembly comprising:

an ice maker; and an ice maker cover that is disposed at a side of the ice maker and covers a portion of the ice maker, wherein the ice maker comprises:

an ice maker case that defines an outer appearance of the ice maker, a first tray fixed to the ice maker case, a second tray configured to move between (i) a closed position in which the second tray is joined with the first tray to define an ice chamber for making ice and (ii) an open position in which the second tray is spaced apart from the first tray for separating the ice from the ice chamber, a first ejector configured to move toward the first tray, and a second ejector disposed on a trajectory of the second tray, the second ejector being configured to apply pressure to the second tray based on the second tray moving along the trajectory toward the open position, and wherein the ice maker cover covers the first tray and the first ejector, the ice maker cover comprising a plurality of cover surfaces that define a recessed space configured to accommodate at least a portion of the first ejector to thereby avoid interference between the first ejector and the ice maker cover.

20. The ice maker assembly of claim 19, wherein the ice maker cover has (i) an inner surface that faces the first ejector and the first tray and (ii) an outer surface that is exposed to cold air guided from a rear side of the ice maker cover toward a front side of the ice maker cover, and wherein the recessed space is recessed outward from the inner surface toward the outer surface and configured to accommodate at least a portion of the first ejector.

* * * * *